US007079084B2

(12) United States Patent
Notohara et al.

(10) Patent No.: US 7,079,084 B2
(45) Date of Patent: Jul. 18, 2006

(54) ANTENNA ELEMENT, LOOP ANTENNA USING THE ANTENNA ELEMENT, AND COMMUNICATIONS CONTROL APPARATUS USING THE ANTENNA FOR WIRELESS COMMUNICATIONS MEDIUM

(75) Inventors: Yasuhiro Notohara, Kasuga (JP); Shinichiro Kaneko, Fukuoka (JP); Shoichi Shimizu, Fukuoka (JP); Koji Yoshida, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1 day.

(21) Appl. No.: 10/975,298

(22) Filed: Oct. 28, 2004

(65) Prior Publication Data

US 2005/0104781 A1 May 19, 2005

(30) Foreign Application Priority Data

Nov. 19, 2003 (JP) ..... 2003-389130
Sep. 28, 2004 (JP) ..... 2004-281826

(51) Int. Cl.
*H01Q 1/52* (2006.01)
*H01Q 7/00* (2006.01)

(52) U.S. Cl. ..... 343/841; 343/866

(58) Field of Classification Search ..... 343/741, 343/702, 700 MS, 841, 866; 455/575.5
See application file for complete search history.

(56) References Cited

U.S. PATENT DOCUMENTS 4,063,245 A * 12/1977 James et al. ..... 343/700 MS
4,203,116 A * 5/1980 Lewin ..... 343/700 MS
5,262,791 A * 11/1993 Tsuda et al. ..... 343/700 MS
6,218,989 B1 * 4/2001 Schneider et al. ... 343/700 MS
6,246,374 B1 6/2001 Perrotta et al.
6,753,815 B1 * 6/2004 Okubora et al. ..... 343/700 MS
6,759,987 B1 * 7/2004 Schmidt et al. ..... 343/700 MS
6,867,746 B1 * 3/2005 Mendolia et al. ..... 343/841
6,946,996 B1 * 9/2005 Koyama ..... 343/700 MS

FOREIGN PATENT DOCUMENTS

| | | |
|---|---|---|
| EP | 0 871 238 A | 10/1998 |
| JP | 10-051225 | 2/1998 |
| JP | 2000-312110 | 11/2000 |
| JP | 2001-326526 | 11/2001 |
| WO | WO 01/48858 A | 7/2001 |
| WO | WO 01/89034 A | 11/2001 |
| WO | WO 2004/025778 A | 3/2004 |

OTHER PUBLICATIONS

International Search Report corresponding to application No. PCT/JP2004/015754 dated Dec. 23, 2004.

* cited by examiner

*Primary Examiner*—Tan Ho
(74) *Attorney, Agent, or Firm*—RatnerPrestia

(57) ABSTRACT

The invention presents an antenna element capable of attenuating electric far filed while suppressing attenuation of magnetic near field of electromagnetic field radiated from loop antenna as an application example of antenna element, and a loop antenna and a communication control apparatus of wireless communications medium using the same.

The antenna element of the invention comprises a conductor, and a conductive electromagnetic shield disposed on its surface by way of an insulator. The conductive electromagnetic shield has a ground contact, a lead portion, and a plurality of branches, and it is composed so as to determine uniquely the route from an arbitrary point of branches to the ground contact by way of the lead portion.

24 Claims, 16 Drawing Sheets

ANTENNA ELEMENT, LOOP ANTENNA USING THE ANTENNA ELEMENT, AND COMMUNICATIONS CONTROL APPARATUS USING THE ANTENNA FOR WIRELESS COMMUNICATIONS MEDIUM

BACKGROUND OF THE INVENTION

1. Field of the Invention

The present invention relates to an antenna element for supplying electric power and transmission data to wireless communications medium such as contactless IC card, and acquiring reception data from the wireless communications medium, a loop antenna using such antenna element, and a wireless communication control apparatus using such loop antenna.

2. Background Art

Hitherto, a radio-frequency identification (RF-ID) system has been known, which is designed to communicate with a wireless communications medium (such as contactless IC card) having an antenna coil without making contact, by making use of electromagnetic induction in an apparatus utilizing radio frequency electromagnetic field.

In this system, a radio frequency magnetic field is used in communications, but the radio frequency electric field is generated simultaneously with the radio frequency magnetic field. The intensity of radio frequency electric field is regulated under law, and to conform to regulation, for example, it is attempted to lower the output of antenna, but communication distance is shortened and other problems are caused. As other countermeasure, for example, as disclosed in Japanese Patent Unexamined Publication No. 2001-326526, it has been proposed to dispose a shielding plate around the antenna.

FIG. 19 is a schematic perspective view of conductive electromagnetic shield disclosed in Japanese Patent Unexamined Publication No. 2001-326526. Shield pattern for electric field 21 is wide enough to cover current feed pattern coil 22, and has an open loop for preventing generation of eddy current which disturbs generation of magnetic field, and is disposed to cover current feed pattern coil 22, and is connected to the ground. In such constitution, it is possible to decrease electric field which may disturb communications of other wireless apparatus while keeping sufficient magnetic field necessary for communications generated by transmission and reception circuit 23 and direct-current cutting capacitor 24.

In spite of such constitution, however, the electric circuit attenuates indeed, but attenuation of magnetic near field necessary in communications is large, and the communication distance becomes extremely short.

SUMMARY OF THE INVENTION

The antenna element of the invention comprises a conductor, and a conductive electromagnetic shield disposed on its surface by way of an insulator, and the conductive electromagnetic shield has a ground contact, a lead portion, and a plurality of branches, and this antenna element is composed so as to determine uniquely the route from an arbitrary point of branches to the ground contact by way of the lead portion. Accordingly, electromagnetic interaction is decreased between the magnetic near field of electromagnetic waves radiated from the conductor of the antenna element and the branch of the conductive electromagnetic shield, and the eddy current generated in the conductive electromagnetic shield is smaller, and attenuation of magnetic near field is suppressed. Further, since the conductive electromagnetic shield is the ground potential, the electric far field is attenuated.

In this antenna element, the conductive electromagnetic shield is comblike (especially "rattail comb"-like), and a comb spine portion is composed of the lead portion having the ground contact at the terminal end, and a comb tooth portion may be composed of the plurality of branches extended therefrom. Further, necessary members of branches are fewer than in bag shape or lattice shape, and insulation at intersection of branches is not necessary.

Also in this antenna element, the conductor extending direction may be formed to intersect with the disposing direction of the comb tooth portion in the comblike conductive electromagnetic shield. As a result, fluctuations of layout of comb tooth portions for composing the conductive electromagnetic shield disposed on the conductor surface are further decreased, and fluctuations are reduced in the individual positions of the antenna element about the attenuation suppressing effect of magnetic near field and attenuation effect of electric far field. Preferably if the conductor extending direction may be formed to cross orthogonally substantially with the disposing direction of the comb tooth portion in the comblike conductive electromagnetic shield, fluctuations are especially reduced.

In the antenna element, the conductive electromagnetic shield may be disposed to cover at least part of the conductor surface by way of the insulator. Accordingly, since the conductive electromagnetic shield is disposed only in the position necessary for transmission and reception of signal on the conductor surface, and by the minimum requirement limit of conductive electromagnetic shield only, attenuation suppressing effect of magnetic near field and attenuation effect of electric far field are obtained at the same time.

In the antenna element, at least either the conductor or the plurality of branches may be covered with the insulator. Since an ordinary adhesive can be used, it is not necessary to manufacture or purchase special adhesive, and the conductive electromagnetic shield can be disposed properly on the conductor surface.

In the antenna element, the conductive electromagnetic shield may be disposed on the conductor surface by an adhesive made of insulating material. As a result, the adhesive made of insulating material is applied only on the surface opposite to the conductor of the conductive electromagnetic shield, and the conductive electromagnetic shield is adhered to the conductor surface, so that the conductive electromagnetic shield and the conductor are insulated by a small amount of insulating material (insulator).

In the antenna element, the conductive electromagnetic shield may be formed as a conductive pattern on the insulator surface. Since the conductive electromagnetic shield is formed by patterning technology, the pattern of the conductive electromagnetic shield having a desired shape is securely disposed in specified position.

The loop antenna may be composed of any one of these antenna elements formed in a loop shape. Accordingly, only the electric far field is attenuated without attenuating the magnetic near field of electromagnetic waves radiated from the loop antenna, and the communication distance with the wireless communication medium is maintained, and EMI (ElectroMagnetic Interference) noise radiated from loop antenna is reduced at the same time.

The communication control apparatus of wireless communication medium comprises this loop antenna, and read/write device connected to the loop antenna. Therefore, only the electric far field is attenuated without attenuating the magnetic near field of electromagnetic wave radiated from the communication control apparatus of wireless communication medium, and the communication distance with the wireless communication medium is maintained, and EMI noise radiated from the communication control apparatus of wireless communication medium is reduced at the same time.

Moreover, the antenna element comprises a conductor, and a conductive electromagnetic shield disposed on its surface by way of an insulator, and the conductive electromagnetic shield has a ground contact, a lead portion, and a plurality of branches, and the plurality of branches may be electrically connected so as to form an open loop and connected to the ground contact by way of the lead portion. Accordingly, electromagnetic interaction is decreased between the magnetic near field of electromagnetic waves radiated from the conductor of the antenna element and the branch of the conductive electromagnetic shield, and the eddy current generated in the conductive electromagnetic shield is smaller, and attenuation of magnetic near field is suppressed. Further, since the conductive electromagnetic shield is the ground potential, the electric far field is attenuated.

In this antenna element, the conductive electromagnetic shield is comblike, and a comb spine portion is composed of the lead portion having the ground contact at the terminal end, and a comb tooth portion may be composed of the plurality of branches extended therefrom. Further, necessary members of branches are fewer than in bag shape or lattice shape, and insulation at intersection of branches is not necessary.

Also in this antenna element, the conductor extending direction may be formed to intersect with the disposing direction of the comb tooth portion in the comblike conductive electromagnetic shield. As a result, fluctuations of layout of comb tooth portions for composing the conductive electromagnetic shield disposed on the conductor surface are further decreased, and fluctuations are reduced in the individual positions of the antenna element about the attenuation suppressing effect of magnetic near field and attenuation effect of electric far field. Preferably if the conductor extending direction may be formed to cross orthogonally substantially with the disposing direction of the comb tooth portion in the comblike conductive electromagnetic shield, fluctuations are especially reduced.

In the antenna element, the conductive electromagnetic shield may be disposed to cover at least part of the conductor surface by way of the insulator. Accordingly, since the conductive electromagnetic shield is disposed only in the position necessary for transmission and reception of signal on the conductor surface, and by the minimum requirement limit of conductive electromagnetic shield only, attenuation suppressing effect of magnetic near field and attenuation effect of electric far field are obtained at the same time.

Further, at least either the conductor or the plurality of branches may be covered with the insulator. Since an ordinary adhesive can be used, it is not necessary to manufacture or purchase special adhesive, and the conductive electromagnetic shield can be disposed properly on the conductor surface.

In the antenna element, the conductive electromagnetic shield may be disposed on the conductor surface by an adhesive made of insulating material. As a result, the adhesive made of insulating material is applied only on the surface opposite to the conductor of the conductive electromagnetic shield, and the conductive electromagnetic shield is adhered to the conductor surface, so that the conductive electromagnetic shield and the conductor are insulated by a small amount of insulating material (insulator).

In the antenna element, the conductive electromagnetic shield may be formed as a conductive pattern on the insulator surface. Since the conductive electromagnetic shield is formed by patterning technology, the pattern of the conductive electromagnetic shield having a desired shape is securely disposed in specified position.

The loop antenna may be composed of any one of these antenna elements formed in a loop shape. Accordingly, only the electric far field is attenuated without attenuating the magnetic near field of electromagnetic waves radiated from the loop antenna, and the communication distance with the wireless communication medium is maintained, and EMI noise radiated from loop antenna is reduced at the same time.

The communication control apparatus of wireless communication medium comprises this loop antenna, and read/write device connected to the loop antenna. Therefore, only the electric far field is attenuated without attenuating the magnetic near field of electromagnetic wave radiated from the communication control apparatus of wireless communication medium, and the communication distance with the wireless communication medium is maintained, and EMI noise radiated from the communication control apparatus of wireless communication medium is reduced at the same time.

Furthermore, the antenna element may be composed by disposing a conductive comblike object on a conductor surface by way of an insulator. Accordingly, electromagnetic interaction is decreased between the magnetic near field of electromagnetic waves radiated from the conductor of the antenna element and the branch of the conductive comblike object, and the eddy current generated in the conductive comblike object is smaller, and attenuation of magnetic near field is suppressed. Further, since the conductive comblike object is the ground potential, the electric far field is attenuated. Still more, necessary members of branches are fewer than in bag shape or lattice shape, and insulation at intersection of branches is not necessary.

Also in this antenna element, the conductor extending direction may be formed to intersect with the disposing direction of the comb tooth portion in the conductive comblike object. As a result, fluctuations of layout of comb tooth portions for composing the conductive comblike object disposed on the conductor surface are further decreased, and fluctuations are reduced in the individual positions of the antenna element about the attenuation suppressing effect of magnetic near field and attenuation effect of electric far field. Preferably if the conductor extending direction may be formed to cross orthogonally substantially with the disposing direction of the comb tooth portion in the conductive comblike object, fluctuations are especially reduced.

In the antenna element, at least either the conductor or the conductive comblike object may be covered with the insulator. Since an ordinary adhesive can be used, it is not necessary to manufacture or purchase special adhesive, and the conductive electromagnetic shield can be disposed properly on the conductor surface.

In the antenna element, the conductive comblike object may be disposed to cover at least part of the conductor surface. Accordingly, since the conductive comblike object is disposed only in the position necessary for transmission and reception of signal on the conductor surface, and by the minimum requirement limit of conductive comblike object only, attenuation suppressing effect of magnetic near field and attenuation effect of electric far field are obtained at the same time.

In the antenna element, the conductive comblike object may be disposed to cover the outer circumference of the conductor surface. As a result, since the conductive comblike object is disposed on the entire circumference of the conductor surface, the attenuation effect of electric far field is obtained to a maximum extent.

In the antenna element, the conductive comblike object may be disposed on the conductor surface by an adhesive made of insulating material. As a result, the adhesive made of insulating material is applied only on the surface opposite to the conductor of the conductive comblike object, and the conductive comblike object is adhered to the conductor surface, so that the conductive comblike object and the conductor are insulated by a small amount of insulating material (insulator).

In the antenna element, the conductive comblike object may be formed as a conductive pattern on the insulator surface. Since the conductive comblike object is formed by patterning technology, the pattern of the conductive comblike object having a desired shape is securely disposed in specified position.

The loop antenna may be composed of any one of these antenna elements formed in a loop shape. Accordingly, only the electric far field is attenuated without attenuating the magnetic near field of electromagnetic waves radiated the loop antenna, and the communication distance with the wireless communication medium is maintained, and EMI noise radiated from loop antenna is reduced at the same time.

The communication control apparatus of wireless communication medium comprises this loop antenna, and read/write device connected to the loop antenna. Therefore, only the electric far field is attenuated without attenuating the magnetic near field of electromagnetic wave radiated from the communication control apparatus of wireless communication medium, and the communication distance with the wireless communication medium is maintained, and EMI noise radiated from the communication control apparatus of wireless communication medium is reduced at the same time.

Thus, according to the invention, EMI noise is suppressed by attenuating the electric far field without attenuating the magnetic near field of antenna element and loop antenna, so that the antenna element capable of effectively utilizing the magnetic near field is presented, together with the loop antenna using the same and the communication control apparatus of wireless communication medium.

DETAILED DESCRIPTION OF THE INVENTION

Embodiments of the invention are described below while referring to FIG. 1 to FIG. 18.

In the invention, the wireless communication medium is any medium capable of communicating with the control apparatus without making contact, such as contactless IC card, IC tag, ID tag, identification label, and RF-ID tag. The communication control apparatus is an apparatus capable of communicating with wireless communication medium the above mentioned, such as reader, reader-writer, and read/write device.

EMBODIMENT 1

Figure 1:
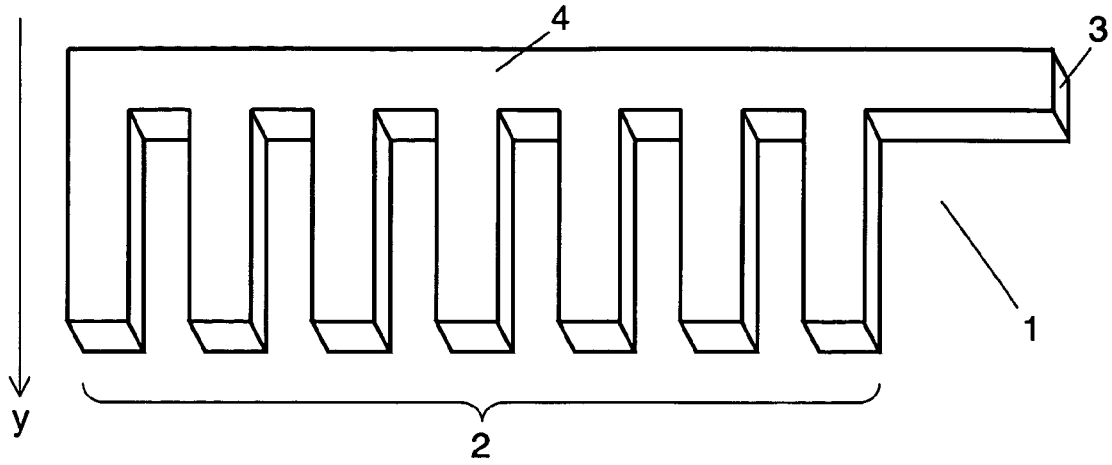
FIG. 1 is a perspective view of conductive electromagnetic shield in embodiment 1.

FIG. 1 is a perspective view of conductive electromagnetic shield in embodiment 1.

As shown in FIG. 1, conductive electromagnetic shield 1 comprises plural branches 2, ground contact 3 for grounding plural branches 2, and lead portion 4 for connecting plural branches 2 and ground contact 3.

Conductive electromagnetic shield 1 is comblike, and lead portion 4 having ground contact 3 at terminal end forms a comb spine portion, and plural branches 2 extended therefrom compose comb tooth portions.

Plural branches 2 are electrically connected to lead portion 4 having ground contact 3 at terminal end in each position. From an electrical point of view, it means that the route from a certain point on branches 2 to ground contact 3 along above branches 2 is determined uniquely. In other words, plural branches 2 are connected to ground contact 3 by way of lead portion 4 by such electric connection as to form an open loop.

In embodiment 1, comblike conductive electromagnetic shield 1 is composed is by integral forming method of, for example, blanking a metal plate into a comblike shape, but it may be also composed by electric connection of plural branches 2 and lead portion 4 by soldering or the like. In this case, various conductive materials may be used for lead portion 4 and branches 2, and it is particularly preferred to use metal wires such as copper wires made of metal materials such as copper. The sectional shape of metal wires for composing lead portion 4 and branches 2 may be circular, elliptic, square, polygonal or any other various shape.

The optimum sectional area orthogonal to y-direction of branches 2 is selected depending on the frequency of electromagnetic wave to be shielded. In the case of electromagnetic wave of low frequency, the sectional area orthogonal to y-direction of branches 2 is not particularly required to be reduced, but in the case of electromagnetic wave of high frequency, the sectional area orthogonal to y-direction of branches 2 is desired to be smaller. When the sectional area orthogonal to y-direction of branches 2 is smaller, the shielding performance of electric far fields begins to deteriorate, and this problem can be solved by using a set of fine wires of small sectional area, that is, Litz wire or by increasing the number of branches 2 per area. In this case, the sectional area orthogonal to y-direction of branches 2 is determined depending on the frequency of electromagnetic wave, and the surface density of branches 2 or the number of twists of Litz wire is determined so as to obtain an optimum shielding performance of electric far field.

Ground contact 3 is a contact point for electrically connecting with the ground of the apparatus when used in the apparatus, and it is a terminal end of lead portion 4. The connecting method includes mechanical connection, soldering method, and others.

Figure 2A:
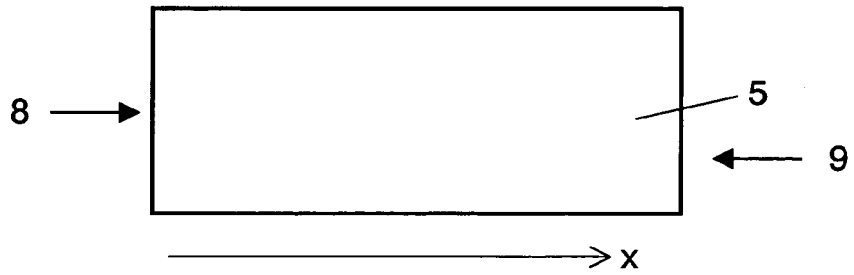
FIG. 2A is a plan view of conductor of antenna element in embodiment 1.
Figure 2B:
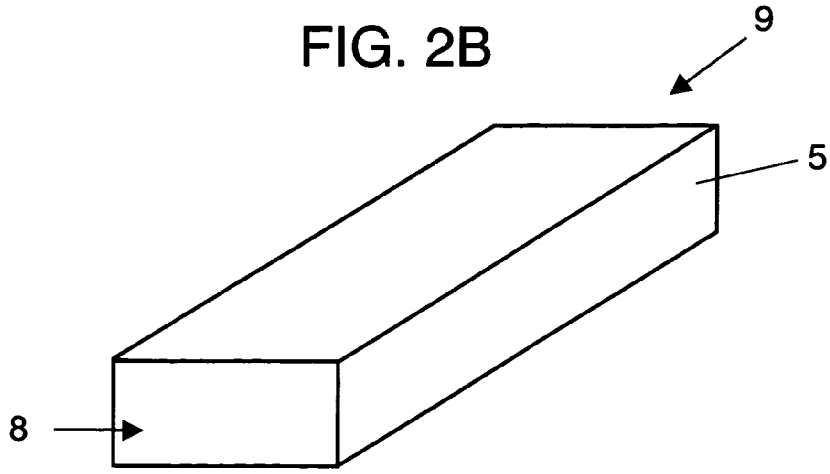
FIG. 2B is a perspective view of conductor of antenna element in embodiment 1.

FIG. 2A is a plan view of conductor of antenna element in embodiment 1. FIG. 2B is a perspective view of conductor of antenna element in embodiment 1 of the invention.

Conductor 5 has open end 8 at one side, and current feed point 9 at other side (or other than open end 8), and functions as antenna element by feeding current. Various conductive materials may be used for composing conductor 5. Its sectional shape is not limited to the rectangular shape shown in FIG. 2B, but includes various shapes such as circular, elliptic, square, polygonal, other shapes, and also cylindrical and other hollow shapes.

Figure 3A:
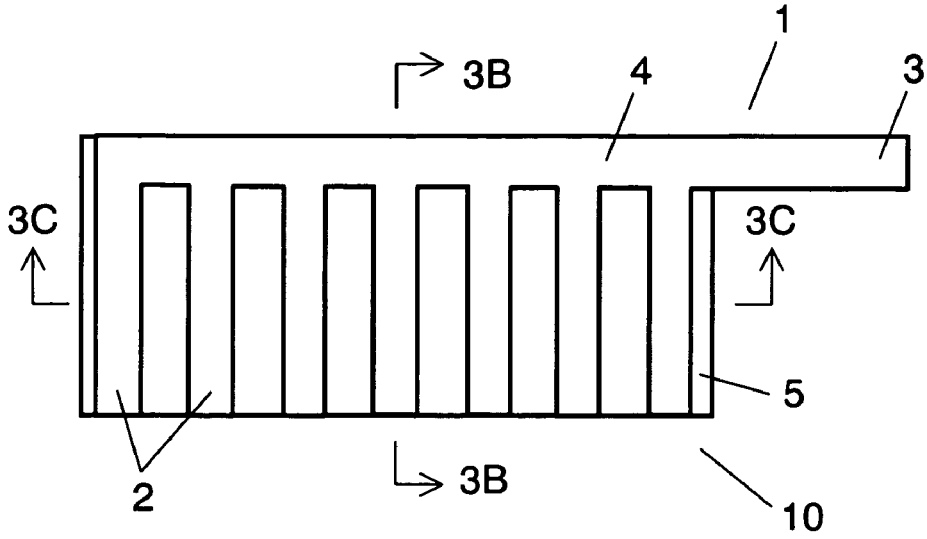
FIG. 3A is a plan view of antenna element in embodiment 1.
Figure 3B:
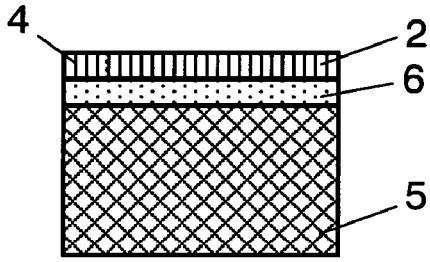
FIG. 3B is a sectional view of 3B—3B in FIG. 3A.
Figure 3C:
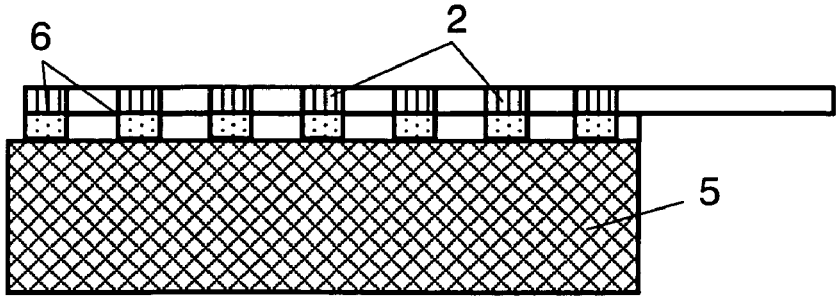
FIG. 3C is a sectional view of 3C—3C in FIG. 3A.

FIG. 3A is a plan view of antenna element in embodiment 1. FIG. 3B is a sectional view of 3B—3B in FIG. 3A. FIG. 3C is a sectional view of 3C—3C in FIG. 3A.

As shown in FIG. 3A, antenna element 10 has comblike conductive electromagnetic shield 1 shown in FIG. 1 disposed on the surface of conductor 5 shown in FIG. 2. Comblike conductive electromagnetic shield 1 is disposed on the surface of conductor 5 so that the extending direction of conductor 5 (arrow x direction in FIG. 2A) may be substantially orthogonal to the disposing direction of plural branches 2 (arrow y direction in FIG. 1) of comblike conductive electromagnetic shield 1, corresponding to comb tooth portions. Herein, the extending direction of conductor 5 is equal to the direction of the current flowing in conductor 5 when current is supplied. If the surface of conductor 5 is a curved surface, or the shape of conductor 5 has curved line or curved point, at such curved surface, curved line or curved point, the extending direction of conductor 5 and the disposing direction of comb tooth portions (that is, branches 2 in embodiment 1) of comblike conductive electromagnetic shield 1 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

In embodiment 1, conductive electromagnetic shield 1 is disposed in part of conductor 5, that is, at one side of conductor 5.

Thus, when conductive electromagnetic shield 1 is disposed at one side of conductor 5, attenuation of magnetic near field radiated from conductor 5 of antenna element 10 is suppressed, and only the electric far field in a specific direction by radiated electromagnetic wave is attenuated effectively. Such constitution is particularly effective when disposing the antenna element in a casing composed of, for example, magnetic material or metal material.

As shown in FIG. 3B and FIG. 3C, branches 2 and lead portion 4 of conductive electromagnetic shield 1 are formed on the surface of conductor 5 by way of insulator 6. That is, conductive electromagnetic shield 1 and conductor 5 are insulated from each other.

In embodiment 1, as shown in FIG. 3A to FIG. 3C, insulator 6 is formed only in the contacting portion of conductive electromagnetic shield 1 and conductor 5. As a result, insulator 6 is composed of small amount of material. An adhesive made of insulating material is applied in the contacting portion of conductive electromagnetic shield 1 and conductor 5, and conductive electromagnetic shield 1 is adhered to the surface of conductor 5, and this adhesive made of insulating material is used as insulator 6, and conductive electromagnetic shield 1 is easily disposed on the surface of conductor 5.

Incidentally, after forming insulator 6 at least in either conductive electromagnetic shield 1 or conductor 5, conductive electromagnetic shield 1 may be merely put on the surface of conductor 5, but in order to prevent deviation of position or considering ease of handling, it is preferred to adhere the two members.

Insulator 6 is required to be thick enough at least to maintain electric insulation between branches 2 and conductor 5. By varying the thickness of insulator 6 over the specified range, the interval of branches 2 and conductor 5 varies, and hence the shielding characteristic changes in magnetic near field and electric far field generated by conductive electromagnetic shield. The thickness of insulator 6, that is, the interval of branches 2 and conductor 5 is selected to as to achieve an optimum shielding characteristic.

The function of conductive electromagnetic shield 1 is explained. As mentioned above, plural branches 2 for composing conductive electromagnetic shield 1 are connected, from an electrical point of view, so that the route from a certain point on branches 2 to ground contact 3 along above branches 2 is determined uniquely. In other words, plural branches 2 are connected to ground contact 3 by way of lead portion 4 by such electric connection as to form an open loop.

It hence suppresses electromagnetic interaction between the magnetic near field radiated from conductor 5 functioning as antenna element by supply of current and conductive electromagnetic shield 1. Therefore, generation of eddy current is also suppressed, and attenuation of magnetic near field is suppressed. By contrast, since branches 2 are at ground potential, attenuation of electric far field is more effectively achieved as compared with the case not using conductive electromagnetic shield 1.

As known from experiments, when using conductive electromagnetic shield 1, as compared with the case not using, the electric far field is attenuated by about 14 dB (measuring position: distance from antenna element=10 m), and at the same time attenuation of magnetic near field is suppressed at about 1 dB (measuring position: distance from antenna element=0.3 m).

The shape of conductive electromagnetic shield 1 is not particularly specified, including bag shape and lattice shape, as far as an open loop is formed by electric connection of branches 2 individually or at each position. Regardless of the shape, the plural branches 2 must be mutually insulated at intersecting positions. Therefore, the preferred shape of conductive electromagnetic shield 1 is comblike as shown in FIG. 1. In this shape, fewer members of branches 2 are needed as compared with bag or lattice shape, and insulation at mutual intersection of branches 2 is not required. In FIG. 1, branches 2 are disposed at only one side of lead portion 4, but branches may be also disposed at both sides of lead portion 4.

Thus, by comblike shape of conductive electromagnetic shield 1 (that is, the extending direction of conductor 5 intersecting (preferably, crossing orthogonally substantially) with the disposing direction of branches 2 of conductive electromagnetic shield 1), conductor 5 can be easily covered with conductive electromagnetic shield 1. If conductor 5 has a curved portion, conductive electromagnetic shield 1 is disposed in a shape to follow the profile. As a result, attenuation of magnetic near field radiated from conductor 5 of antenna element 10 is suppressed, and only the electric far field radiated from conductor 5 of antenna element 10 in a specific direction is effectively attenuated. Besides, by the comblike shape of conductive electromagnetic shield 1, fewer members of branches 2 are needed as compared with bag or lattice shape, and insulation at mutual intersection of branches 2 is not required.

EMBODIMENT 2

Figure 4A:
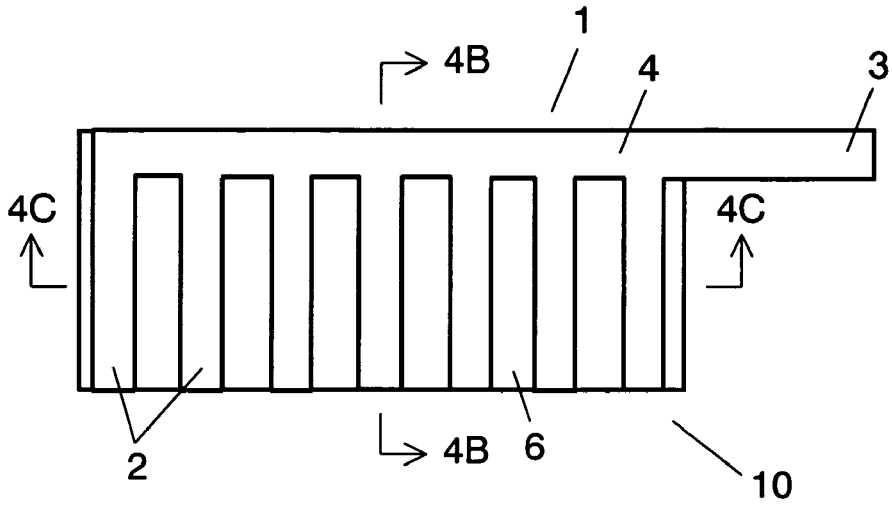
FIG. 4A is a plan view of antenna element in embodiment 2.
Figure 4B:
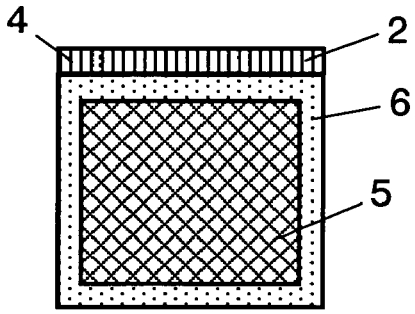
FIG. 4B is a sectional view of 4B—4B in FIG. 4A.
Figure 4C:
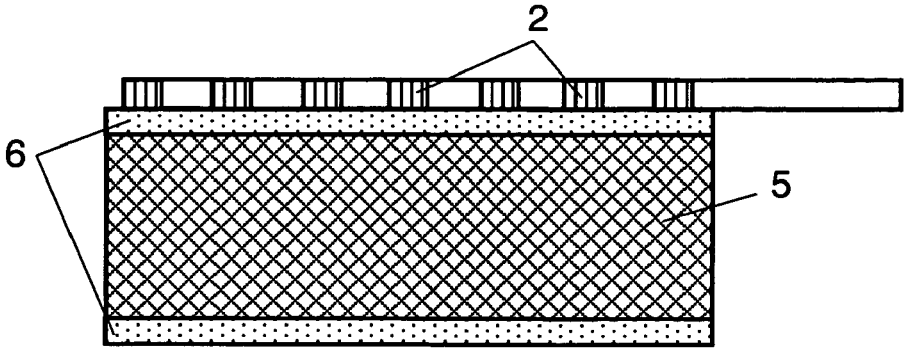
FIG. 4C is a sectional view of 4C—4C in FIG. 4A.

FIG. 4A is a plan view of antenna element in embodiment 2. FIG. 4B is a sectional view of 4B—4B in FIG. 4A. FIG. 4C is a sectional view of 4C—4C in FIG. 4A.

As shown in FIG. 4A, antenna element 10 has comblike conductive electromagnetic shield 1 disposed on the surface of conductor 5. Comblike conductive electromagnetic shield 1 is disposed on the surface of conductor 5 so that the extending direction of conductor 5 may be substantially orthogonal to the disposing direction of plural branches 2 corresponding to comb tooth portions of comblike conductive electromagnetic shield 1. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 2 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

As shown in FIG. 4B and FIG. 4C, branches 2 and lead portion 4 of conductive electromagnetic shield 1 are formed on the surface of conductor 5 covered with insulator 6. That is, conductive electromagnetic shield 1 and conductor 5 are insulated from each other.

In embodiment 2, as shown in FIG. 4A to FIG. 4C, the outer circumference of conductor 5 is covered with insulator 6, and conductive electromagnetic shield 1 is formed on its surface. An adhesive is applied in the portion contacting with conductor 5 covered with insulator 6 of conductive electromagnetic shield 1, and conductive electromagnetic shield 1 is adhered to the surface of conductor 5 covered with insulator 6, and conductive electromagnetic shield 1 is easily formed on the surface of conductor 5. That is, since the outer circumference of conductor 5 is covered with insulator 6, by using an ordinary adhesive, conductive electromagnetic shield 1 may be easily disposed on the surface of conductor 5 without manufacturing or purchasing special adhesive.

EMBODIMENT 3

Figure 5A:
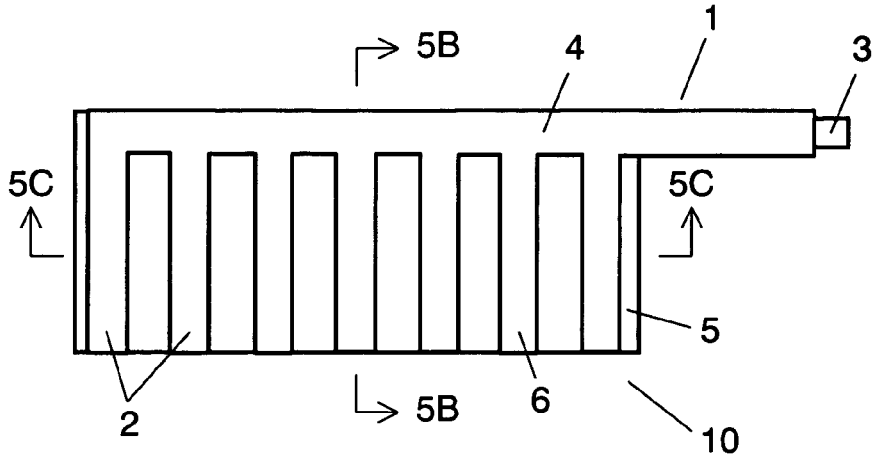
FIG. 5A is a plan view of antenna element in embodiment 3.
Figure 5B:
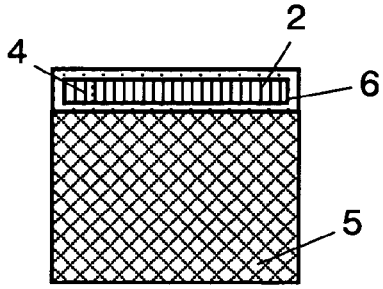
FIG. 5B is a sectional view of 5B—5B in FIG. 5A.
Figure 5C:
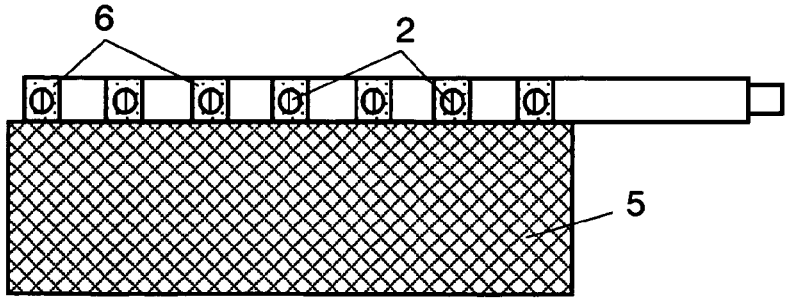
FIG. 5C is a sectional view of 5C—5C in FIG. 5A.

FIG. 5A is a plan view of antenna element in embodiment 3. FIG. 5B is a sectional view of 5B—5B in FIG. 5A. FIG. 5C is a sectional view of 5C—5C in FIG. 5A.

As shown in FIG. 5A, antenna element 10 has comblike conductive electromagnetic shield 1 disposed on the surface of conductor S. Comblike conductive electromagnetic shield 1 is disposed on the surface of conductor 5 so that the extending direction of conductor 5 may be substantially orthogonal to the disposing direction of plural branches 2 corresponding to comb tooth portions of comblike conductive electromagnetic shield 1. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 3 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

As shown in FIG. 5B and FIG. 5C, branches 2 and lead portion 4 of conductive electromagnetic shield 1 are covered with insulator 6, and conductive electromagnetic shield 1 covered with insulator 6 is formed on the surface of conductor 5. That is, conductive electromagnetic shield 1 and conductor 5 are insulated from each other.

In embodiment 3, as shown in FIG. 5A to FIG. 5C, conductive electromagnetic shield 1 covered with insulator 6 is formed on the surface of conductor 5. An adhesive is applied in the portion contacting with conductor 5 of conductive electromagnetic shield 1 covered with insulator 6, and it is adhered to the surface of conductor 5, and conductive electromagnetic shield 1 is easily formed on the surface of conductor 5. That is, since the outer circumference of conductive electromagnetic shield 1 is covered with insulator 6, by using an ordinary adhesive, conductive electromagnetic shield 1 may be easily disposed on the surface of conductor 5 without manufacturing or purchasing special adhesive.

The composition of conductive electromagnetic shield 1, conductor 5 and insulator 6 for insulating them may be realized by combining parts of the composition explained so far in embodiments 1 to 3. For example, by combining the compositions of embodiment 2 and embodiment 3, conductive electromagnetic shield 1 covered with insulator 6 shown in FIG. 5 may be formed on the surface of conductor 5 covered with insulator 6 shown in FIG. 4.

Further, insulator 6 is not limited to coating or adhesive made of insulating material of electromagnetic shield 1 or conductor 5 as in embodiments 1 to 3, but may be an independent member. In such a case, insulator 6 is disposed between conductive electromagnetic shield 1 and conductor 5, and by adhering the mutually opposite surfaces, the antenna element of the invention is formed.

EMBODIMENT 4

Figure 6:
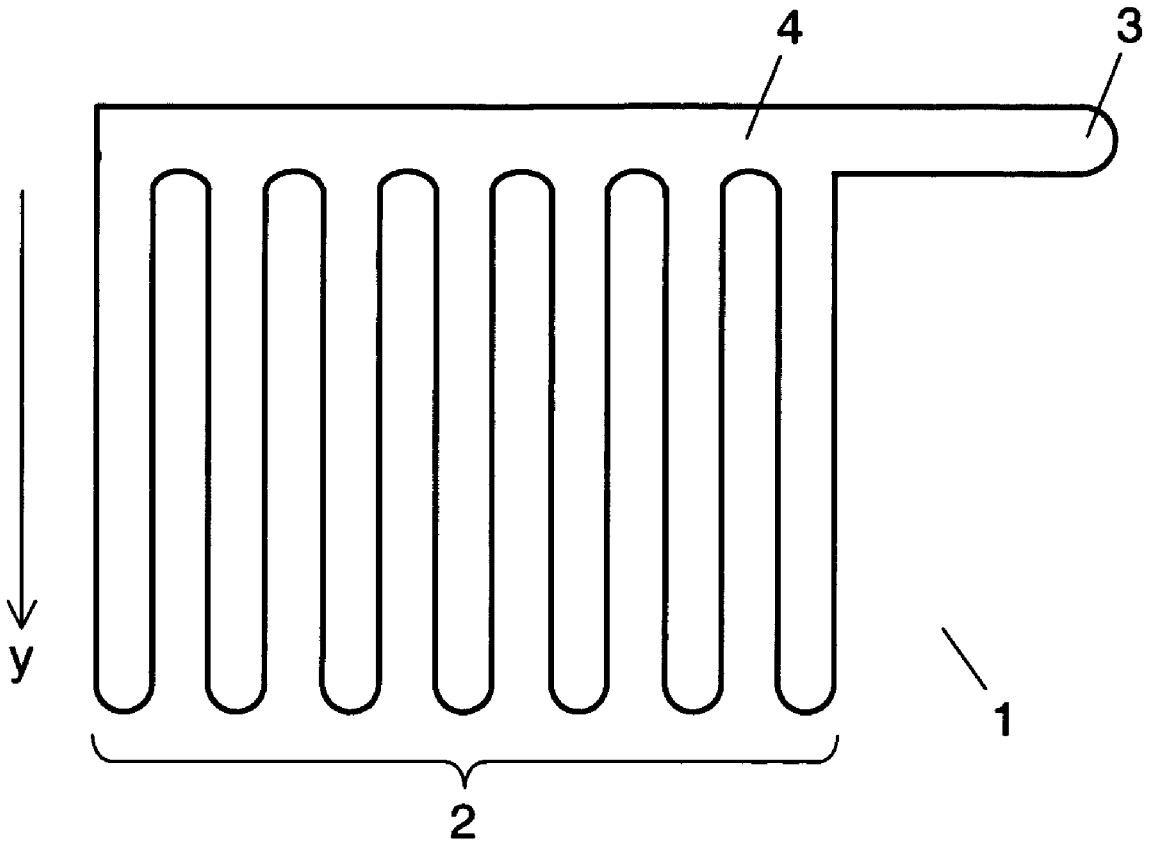
FIG. 6 is a plan view of conductive electromagnetic shield in embodiment 4.

FIG. 6 is a plan view of conductive electromagnetic shield in embodiment 4.

As shown in FIG. 6, conductive electromagnetic shield 1 comprises plural branches 2, ground contact 3 for grounding plural branches 2, and lead portion 4 for connecting plural branches 2 and ground contact 3.

Conductive electromagnetic shield 1 is comblike, and lead portion 4 having ground contact 3 at terminal end forms a comb spine portion, and plural branches 2 extended therefrom compose comb tooth portions.

Plural branches 2 are electrically connected to lead portion 4 having ground contact 3 at terminal end in each position. From an electrical point of view, it means that the route from a certain point on branches 2 to ground contact 3 along above branches 2 is determined uniquely. In other words, plural branches 2 are connected to ground contact by way of lead portion by such electric connection as to form an open loop.

Figure 7A:
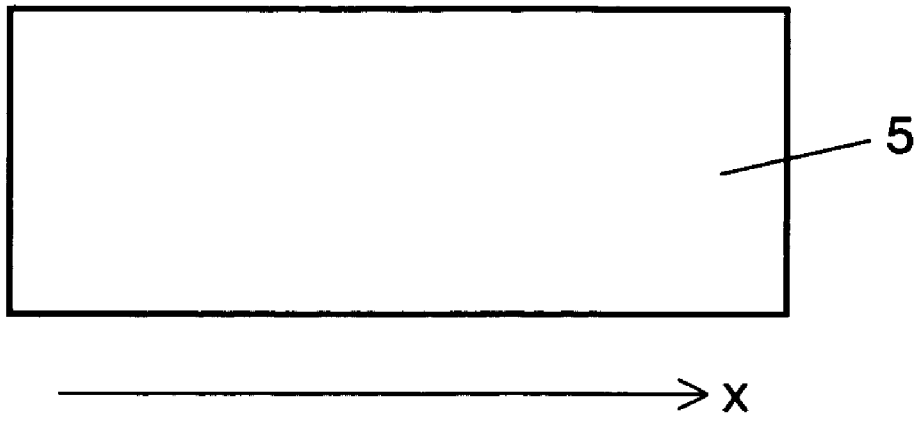
FIG. 7A is a plan view of conductor of antenna element in embodiment 4.
Figure 7B:
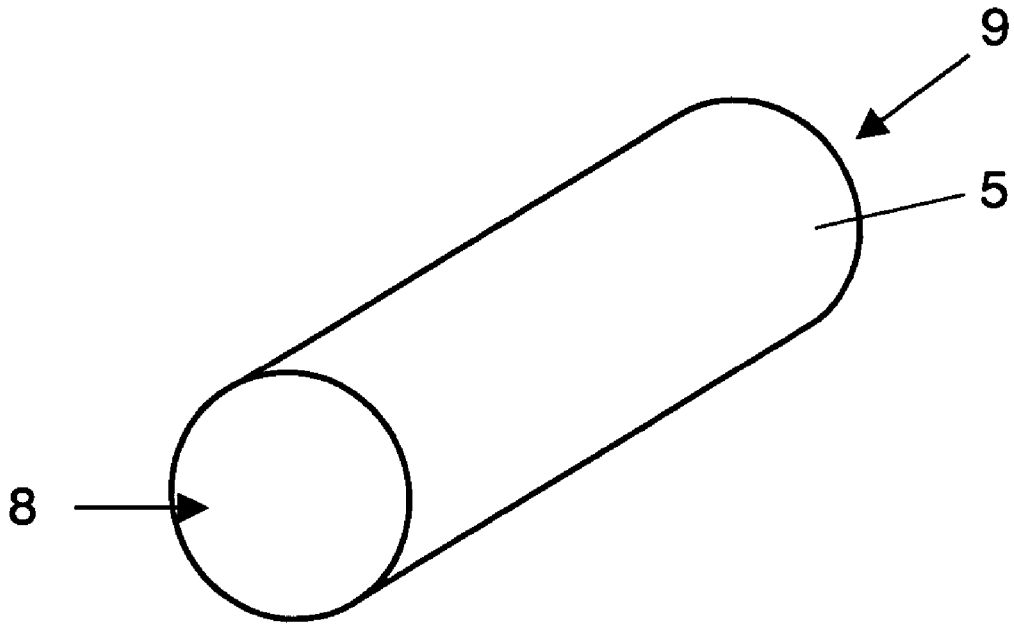
FIG. 7B is a perspective view of conductor of antenna element in embodiment 4.

FIG. 7A is a plan view of conductor of antenna element in embodiment 4. FIG. 7B is a perspective view of conductor of antenna element in embodiment 4.

Conductor 5 has open end 8 at one side, and current feed point 9 at other side (or other than open end 8), and functions as antenna element by feeding current. The sectional shape of conductor 5 is not limited to the circular shape shown in FIG. 7B, but includes various shapes such as elliptic, square, polygonal, other shapes, and also cylindrical and other hollow shapes.

Figure 8A:
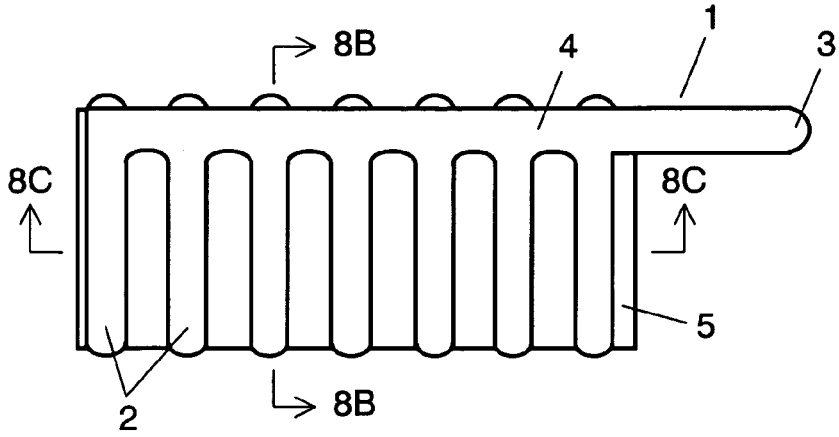
FIG. 8A is a plan view of antenna element in embodiment 4.
Figure 8B:
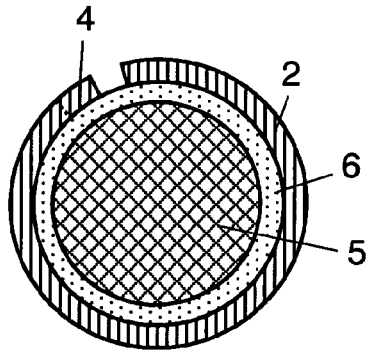
FIG. 8B is a sectional view of 8B—8B in FIG. 8A.
Figure 8C:
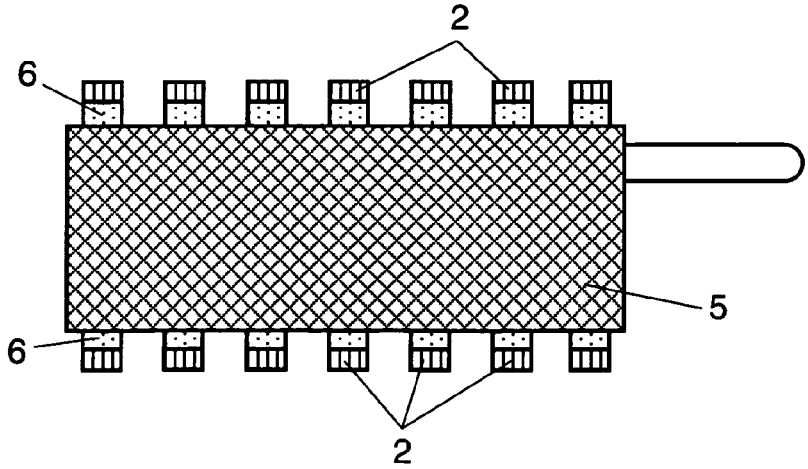
FIG. 8C is a sectional view of 8C—8C in FIG. 8A.

FIG. 8A is a plan view of antenna element in embodiment 4. FIG. 8B is a sectional view of 8B—8B in FIG. 8A. FIG. 8C is a sectional view of 8C—8C in FIG. 8A.

As shown in FIG. 8A, antenna element 10 has comblike conductive electromagnetic shield 1 disposed on the surface of conductor 5 shown in FIG. 7. Comblike conductive electromagnetic shield 1 is disposed on the surface of conductor 5 so that the extending direction of conductor 5 (arrow x direction in FIG. 7A) may be substantially orthogonal to the disposing direction of plural branches 2 (arrow y direction in FIG. 6) of comblike conductive electromagnetic shield 1, corresponding to tooth portions of comb. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 4 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

In embodiment 4, unlike embodiment 1, instead of disposing conductive electromagnetic shield 1 in part of conductor 5, that is, at one side of conductor 5, conductive electromagnetic shield 1 is disposed so as to cover the outer circumference of conductor 5.

Thus, when conductive electromagnetic shield 1 is disposed so as to cover the entire outer circumference of conductor 5, attenuation of magnetic near field radiated from conductor 5 of antenna element 10 is suppressed, and electric far field in all direction by radiated electromagnetic wave is attenuated effectively. Function of conductive electromagnetic shield 1 is same as in embodiment 1.

As shown in FIG. 8B and FIG. 8C, branches 2 and lead portion 4 of conductive electromagnetic shield 1 are formed on the surface of conductor 5 by way of insulator 6. Conductive electromagnetic shield 1 and conductor 5 are insulated from each other.

In embodiment 4, as shown in FIG. 8A to FIG. 8C, insulator 6 is formed only in the contacting portion of conductive electromagnetic shield 1 and conductor 5. Hence, a small amount of member is enough for insulator 6. An adhesive made of insulating material is applied in the portion contacting with conductor 5 of conductive electromagnetic shield 1, and conductive electromagnetic shield 1 is adhered to the surface of conductor 5, and the adhesive made of insulating material is insulator 6, and conductive electromagnetic shield 1 is easily disposed on the surface of conductor 5.

EMBODIMENT 5

Figure 9A:
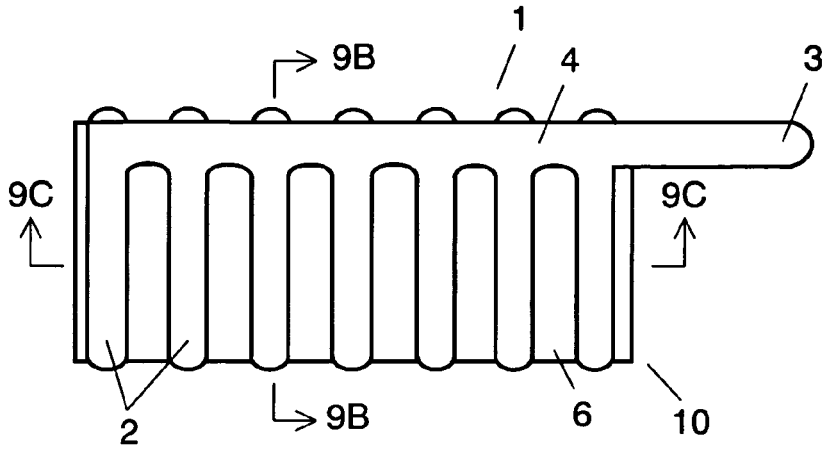
FIG. 9A is a plan view of antenna element in embodiment 5.
Figure 9B:
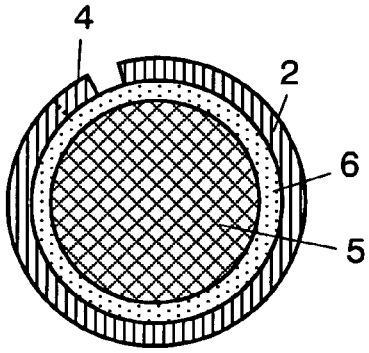
FIG. 9B is a sectional view of 9B—9B in FIG. 9A.
Figure 9C:
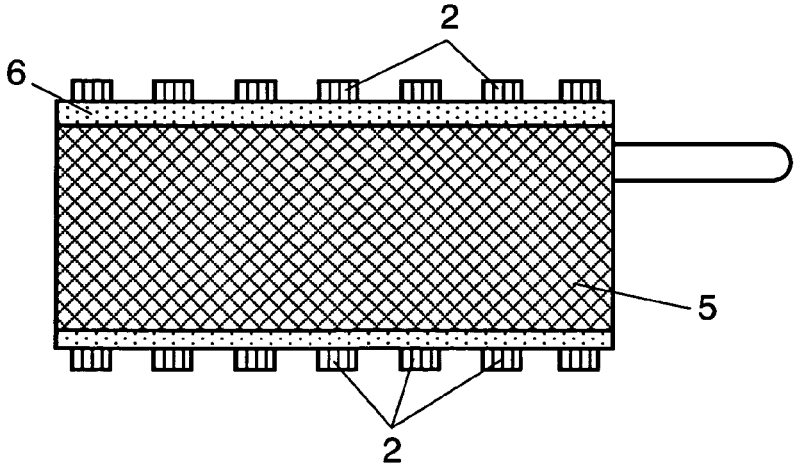
FIG. 9C is a sectional view of 9C—9C in FIG. 9A.

FIG. 9A is a plan view of antenna element in embodiment 5. FIG. 9B is a sectional view of 9B—9B in FIG. 9A. FIG. 9C is a sectional view of 9C—9C in FIG. 9A.

As shown in FIG. 9A, antenna element 10 has comblike conductive electromagnetic shield 1 disposed on the surface of conductor 5. Comblike conductive electromagnetic shield 1 is disposed on the surface of conductor 5 so that the extending direction of conductor 5 may be substantially orthogonal to the disposing direction of plural branches 2 corresponding to comb tooth portions of comblike conductive electromagnetic shield 1. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 5 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

As shown in FIG. 9B and FIG. 9C, branches 2 and lead portion 4 of conductive electromagnetic shield 1 are formed on the surface of conductor 5 covered with insulator 6. That is, conductive electromagnetic shield 1 and conductor 5 are insulated from each other.

In embodiment 5, as shown in FIG. 9A to FIG. 9C, the outer circumference of conductor 5 is covered with insulator 6, and conductive electromagnetic shield 1 is formed on its surface. An adhesive is applied in the portion contacting with conductor 5 covered with insulator 6 of conductive electromagnetic shield 1, and conductive electromagnetic shield 1 is adhered to the surface of conductor 5 covered with insulator 6, so that conductive electromagnetic shield 1 is easily formed on the surface of conductor 5. That is, since the outer circumference of conductor 5 is covered with insulator 6, by using an ordinary adhesive, conductive electromagnetic shield 1 may be easily disposed on the surface of conductor 5 without manufacturing or purchasing special adhesive.

EMBODIMENT 6

Figure 10A:
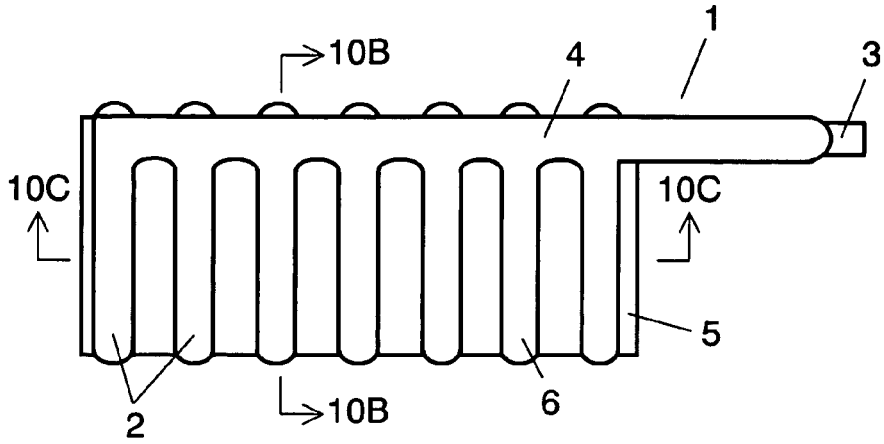
FIG. 10A is a plan view of antenna element in embodiment 6.
Figure 10B:
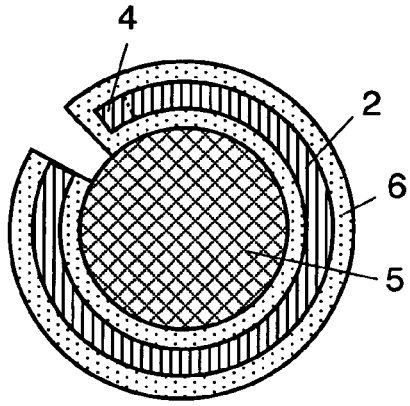
FIG. 10B is a sectional view of 10B—10B in FIG. 10A.
Figure 10C:
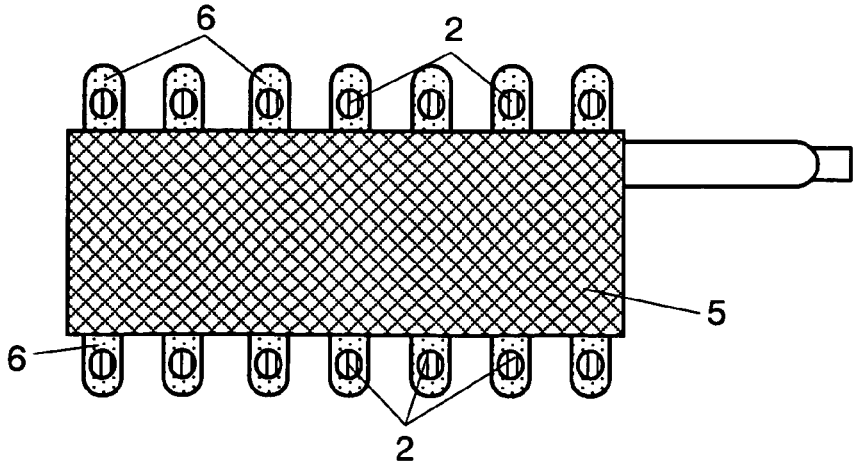
FIG. 10C is a sectional view of 10C—10C in FIG. 10A.

FIG. 10A is a plan view of antenna element in embodiment 6. FIG. 10B is a sectional view of 10B—10B in FIG. 10A. FIG. 10C is a sectional view of 10C—10C in FIG. 10A.

As shown in FIG. 10A, antenna element 10 has comblike conductive electromagnetic shield 1 disposed on the surface of conductor 5. Comblike conductive electromagnetic shield 1 is disposed on the surface of conductor 5 so that the extending direction of conductor 5 may be substantially orthogonal to the disposing direction of plural branches 2 corresponding to comb tooth portions of comblike conductive electromagnetic shield 1. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 6 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

As shown in FIG. 10B and FIG. 10C, branches 2 and lead portion 4 of conductive electromagnetic shield 1 are covered with insulator 6, and conductive electromagnetic shield 1 covered with insulator 6 is formed on the surface of conductor 5. That is, conductive electromagnetic shield 1 and conductor 5 are insulated from each other.

In embodiment 6, as shown in FIG. 10A to FIG. 10C, conductive electromagnetic shield 1 covered with insulator 6 is formed on the surface of conductor 5. An adhesive is applied in the portion contacting with conductor 5 of conductive electromagnetic shield 1 covered with insulator 6, and it is adhered to the surface of conductor 5, and conductive electromagnetic shield 1 is easily formed on the surface of conductor 5. That is, since the outer circumference of conductive electromagnetic shield 1 is covered with insulator 6, by using an ordinary adhesive, conductive electromagnetic shield 1 may be easily disposed on the surface of conductor 5 without manufacturing or purchasing special adhesive.

The composition of conductive electromagnetic shield 1, conductor 5 and insulator 6 for insulating them may be realized by combining parts of the composition explained so far in embodiments 4 to 6. For example, by combining the compositions of embodiment 5 and embodiment 6, conductive electromagnetic shield 1 covered with insulator 6 shown in FIG. 10 may be formed on the surface of conductor 5 covered with insulator 6 shown in FIG. 9.

Further, insulator 6 is not limited to coating or adhesive made of insulating material of electromagnetic shield 1 or conductor 5 as in embodiments 4 to 6, but may be an independent member. In such a case, insulator 6 is disposed between conductive electromagnetic shield 1 and conductor 5, and by adhering the mutually opposite surfaces, the antenna element of the invention is formed.

EMBODIMENT 7

Figure 11A:
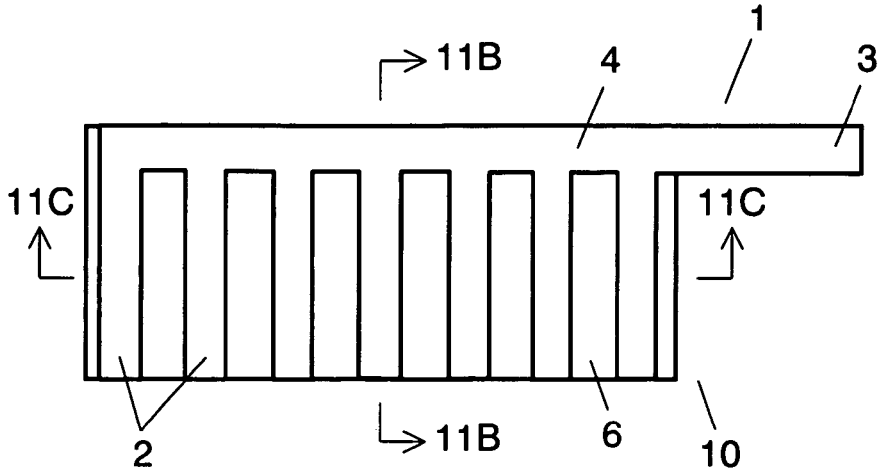
FIG. 11A is a plan view of antenna element in embodiment 7.
Figure 11B:
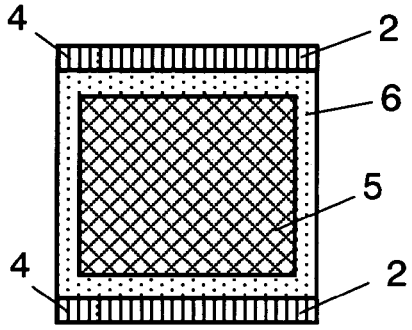
FIG. 11B is a sectional view of 11B—11B in FIG. 11A.
Figure 11C:
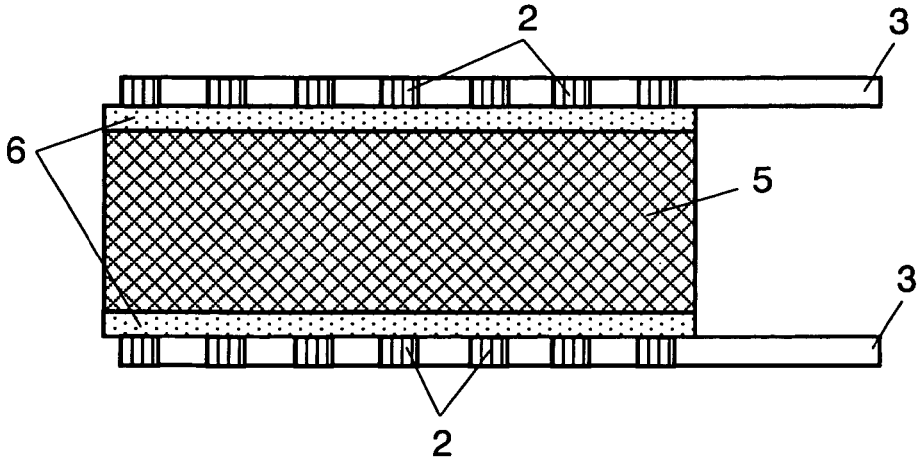
FIG. 11C is a sectional view of 11C—11C in FIG. 11A.

FIG. 11A is a plan view of antenna element in embodiment 7. FIG. 11B is a sectional view of 11B—11B in FIG. 11A. FIG. 11C is a sectional view of 11C—11C in FIG. 11A.

As shown in FIG. 11A, two conductive electromagnetic shields 1 are formed like comb, composed of plural branches 2, ground contact 3 for grounding these plural branches 2, and lead portion 4 for connecting plural branches 2 and ground contact 3. Antenna element 10 has comblike conductive electromagnetic shields 1 disposed on two surfaces of conductor 5. Comblike conductive electromagnetic shields 1 are disposed on two surfaces of conductor 5 so that the extending direction of conductor 5 may be substantially orthogonal to the disposing direction of plural branches 2 corresponding to comb tooth portions of comblike conductive electromagnetic shields 1. Herein, the function of conductive electromagnetic shields 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shields 1, that is, branches 2 in embodiment 7 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

Thus, when conductive electromagnetic shields 1 are disposed on two surfaces of conductor 5, attenuation of magnetic near field radiated from conductor 5 of antenna element 10 is suppressed, and electric far field in two directions by radiated electromagnetic wave is effectively attenuated. The function of conductive electromagnetic shields 1 is same as in embodiment 1.

As shown in FIG. 11B and FIG. 11C, branches 2 and lead portion 4 of first conductive electromagnetic shield 1 are formed on one surface of conductor 5 covered with insulator 6. In this constitution, conductive electromagnetic shield 1 and conductor 5 are insulated from each other. Similarly, branches 2 and lead portion 4 of second conductive electromagnetic shield 1 are formed on other surface of conductor 5 covered with insulator 6. In this constitution, conductive electromagnetic shield 1 and conductor 5 are insulated from each other.

In embodiment 7, as shown in FIG. 11A to FIG. 11C, the outer circumference of conductor 5 is covered with insulator 6, and conductive electromagnetic shields 1 are formed on the surface. An adhesive is applied in the portion contacting with conductor 5 covered with insulator 6 of two conductive electromagnetic shields 1, and they are adhered to two surfaces of conductor 5 covered with insulator 6, and conductive electromagnetic shields 1 are easily formed on the surfaces of conductor 5. That is, since the outer circumference of conductor 5 is covered with insulator 6, by using an ordinary adhesive, two conductive electromagnetic shields 1 may be easily disposed on two surfaces of conductor 5 without manufacturing or purchasing special adhesive.

EMBODIMENT 8

Figure 12A:
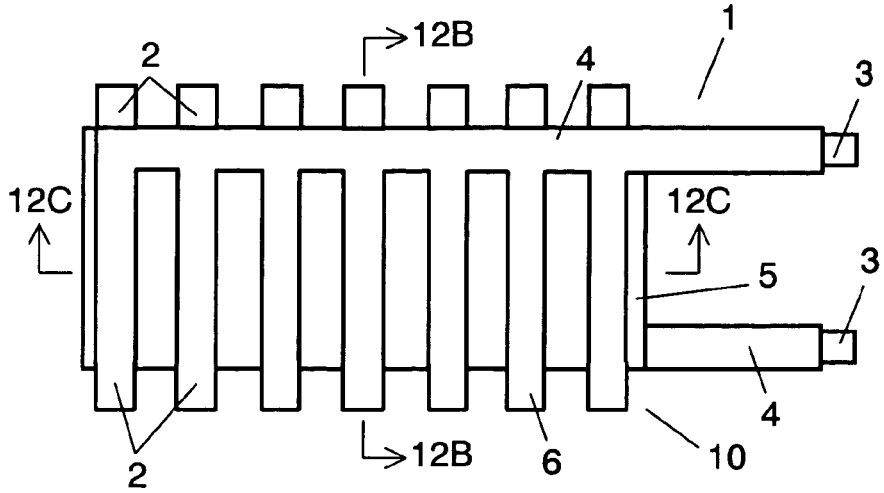
FIG. 12A is a plan view of antenna element in embodiment 8.
Figure 12B:
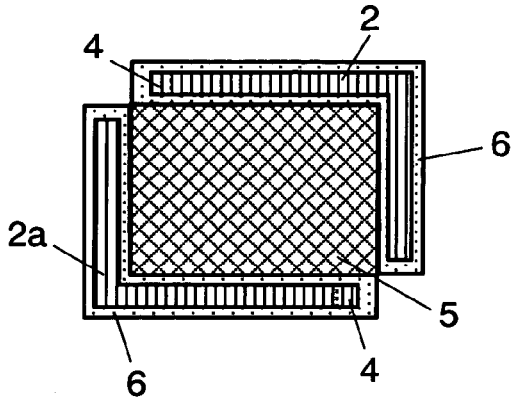
FIG. 12B is a sectional view of 12B—12B in FIG. 12A.
Figure 12C:
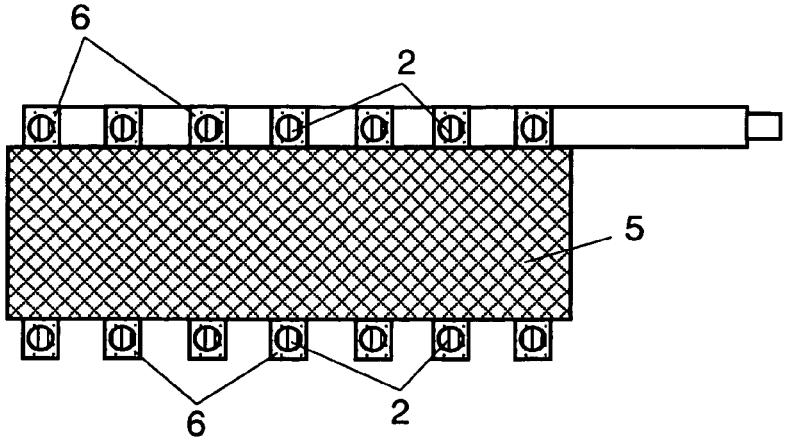
FIG. 12C is a sectional view of 12C—12C in FIG. 12A.

FIG. 12A is a plan view of antenna element in embodiment 8. FIG. 12B is a sectional view of 12B—12B in FIG. 12A. FIG. 12C is a sectional view of 12C—12C in FIG. 12A.

As shown in FIG. 12A, two conductive electromagnetic shields 1 are formed like comb, composed of plural branches 2, ground contact 3 for grounding these plural branches 2, and lead portion 4 for connecting plural branches 2 and ground contact 3, and the surface excluding ground contact 3 is covered with insulator 6. Antenna element 10 has comblike conductive electromagnetic shields 1 disposed on entire outer circumference of conductor 5. Comblike conductive electromagnetic shields 1 are disposed on the surface of conductor 5 so that the extending direction of conductor 5 may be substantially orthogonal to the disposing direction of plural branches 2 corresponding to comb tooth portions of comblike conductive electromagnetic shields 1. Herein, the function of conductive electromagnetic shields 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shields 1, that is, branches 2 in embodiment 8 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

In the antenna element of embodiment 8, two conductive electromagnetic shields 1 are disposed on two consecutive surfaces of conductor 5, and are formed to cover the entire outer circumference of conductor 5.

Thus, when conductive electromagnetic shields 1 are disposed on the entire outer circumference of conductor 5, attenuation of magnetic near field radiated from conductor 5 of antenna element 10 is suppressed, and electric far field in all directions by radiated electromagnetic wave is effectively attenuated. The function of conductive electromagnetic shields 1 is same as in embodiment 1.

As shown in FIG. 12B and FIG. 12C, branches 2 and lead portion 4 of first conductive electromagnetic shield 1 are covered with insulator 6, and first conductive electromagnetic shield 1 covered with insulator 6 is formed on one surface of conductor 5, and branches 2 of first conductive electromagnetic shield 1 are extended and formed at one side. In this constitution, conductive electromagnetic shield 1 and conductor 5 are insulated from each other. Similarly, branches 2 and lead portion 4 of second conductive electromagnetic shield 1 are covered with insulator 6, and second conductive electromagnetic shield 1 covered with insulator 6 is formed on other surface of conductor 5, and branches 2 of second conductive electromagnetic shield 1 are extended and formed at other side. In this constitution, conductive electromagnetic shield 1 and conductor 5 are insulated from each other.

In embodiment 8, as shown in FIG. 12A to FIG. 12C, two conductive electromagnetic shields 1 covered with insulator 6 are formed on the surface of conductor 5. An adhesive is applied in the portion contacting with conductor 5 of two conductive electromagnetic shields 1 covered with insulator 6, and they are adhered to the surface of conductor 5, and conductive electromagnetic shields 1 are easily formed on the surface of conductor 5. That is, since the outer circumference of conductive electromagnetic shields 1 is covered with insulator 6, by using an ordinary adhesive, two conductive electromagnetic shields 1 may be easily disposed on the entire outer circumference of conductor 5 without manufacturing or purchasing special adhesive.

EMBODIMENT 9

Figure 13A:
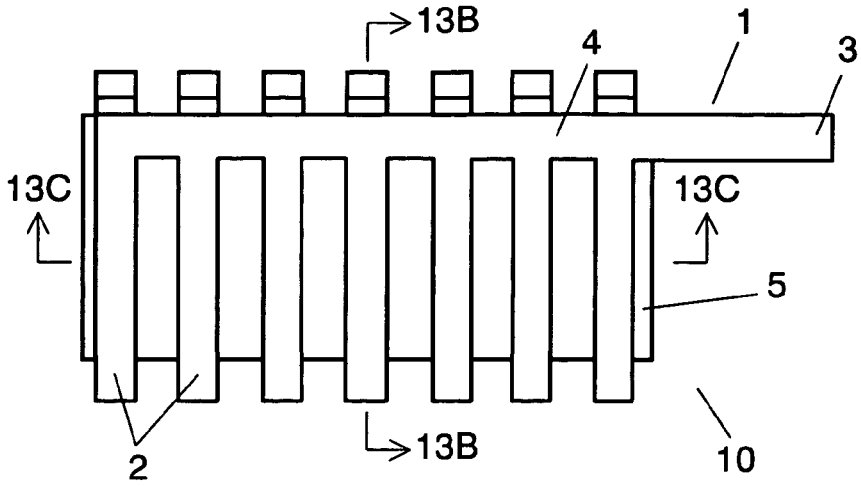
FIG. 13A is a plan view of antenna element in embodiment 9.
Figure 13B:
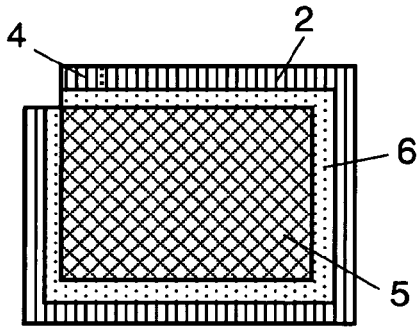
FIG. 13B is a sectional view of 13B—13B in FIG. 13A.
Figure 13C:
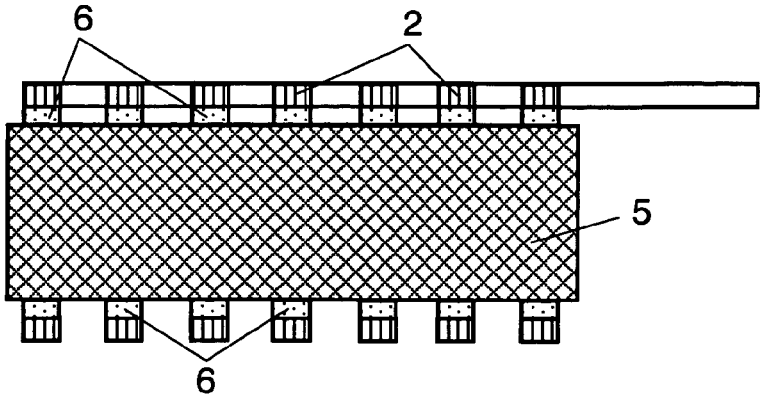
FIG. 13C is a sectional view of 13C—13C in FIG. 13A.

FIG. 13A is a plan view of antenna element in embodiment 9. FIG. 13B is a sectional view of 13B—13B in FIG. 13A. FIG. 13C is a sectional view of 13C—13C in FIG. 13A.

As shown in FIG. 13A, antenna element 10 has comblike conductive electromagnetic shield 1 disposed on the entire outer circumference of conductor 5 on the surface of conductor 5. Comblike conductive electromagnetic shield 1 is disposed on the surface of conductor 5 so that the extending direction of conductor 5 may be substantially orthogonal to the disposing direction of plural branches 2 corresponding to comb tooth portions of comblike conductive electromagnetic shield 1. Herein, the function of conductive electromagnetic shield 1 is same as in embodiment 1. If the surface of conductor 5 is a curved surface, or the shape of conductor 5 has curved line or curved point, at such curved surface, curved line or curved point, the extending direction of conductor 5 and the disposing direction of comb tooth portions of comblike conductive electromagnetic shield 1, that is, branches 2 in embodiment 9 may not be substantially orthogonal. In such a case, even if the layout of branches 2 is slightly inclined, the extending direction of conductor 5 and the disposing direction of branches 2 are arranged to intersect. As a result, fluctuations of layout of branches 2 for composing the conductive electromagnetic shield 1 disposed on the conductor 5 surface are further decreased, and fluctuations are reduced in the individual positions of the antenna element 10 about the attenuation suppressing effect of magnetic near field and attenuation effect of electric far field. Preferably if the conductor 5 extending direction may be formed to cross orthogonally substantially with the disposing direction of branches 2 in the comblike conductive electromagnetic shield 1, fluctuations are especially reduced.

In embodiment 9, conductive electromagnetic shield 1 is disposed on the entire outer circumference of conductor 5, including the face and back sides, and right and left sides.

Thus, when conductive electromagnetic shield 1 is disposed to cover the entire outer circumference of conductor 5, attenuation of magnetic near field radiated from conductor 5 of antenna element 10 is suppressed, and electric far field in all directions by radiated electromagnetic wave is effectively attenuated. The function of conductive electromagnetic shield 1 is same as in embodiment 1.

As shown in FIG. 13B and FIG. 13C, branches 2 and lead portion 4 of conductive electromagnetic shield 1 are formed on one surface of conductor 5 by way of insulator 6, and branches 2 of conductive electromagnetic shield 1 are extended and formed to other three surfaces of conductor 5 by way of insulator 6. In this constitution, conductive electromagnetic shield 1 and conductor 5 are insulated from each other.

In embodiment 9, as shown in FIG. 13A to FIG. 13C, insulator 6 is formed only in the contacting portion of conductive electromagnetic shield 1 and conductor 5. Hence, only a small portion of member is enough for insulator 6. An adhesive made of insulating material is applied in the portion contacting with conductor 5 of conductive electromagnetic shield 1, and conductive electromagnetic shield 1 is adhered to the surface of conductor 5, so that the adhesive made of insulating material serves as insulator 6, and conductive electromagnetic shield 1 is easily formed on the surface of conductor 5.

EMBODIMENT 10

Figure 14A:
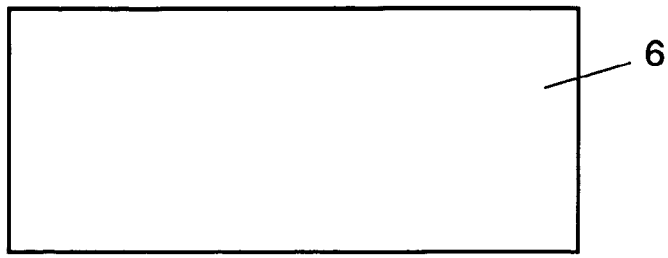
FIG. 14A is a plan view of insulator of conductive electromagnetic shield in embodiment 10.
Figure 14B:
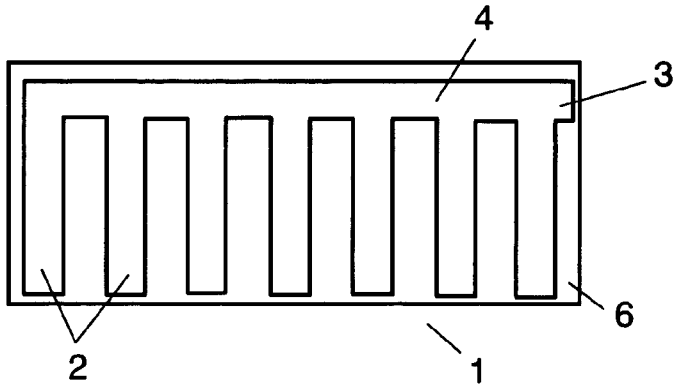
FIG. 14B is a plan view of conductive electromagnetic shield in embodiment 10.
Figure 14C:
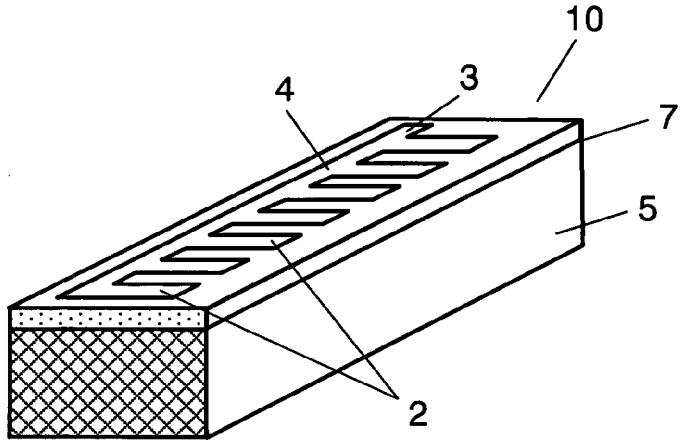
FIG. 14C is a perspective view of antenna element in embodiment 10.
Figure 14D:
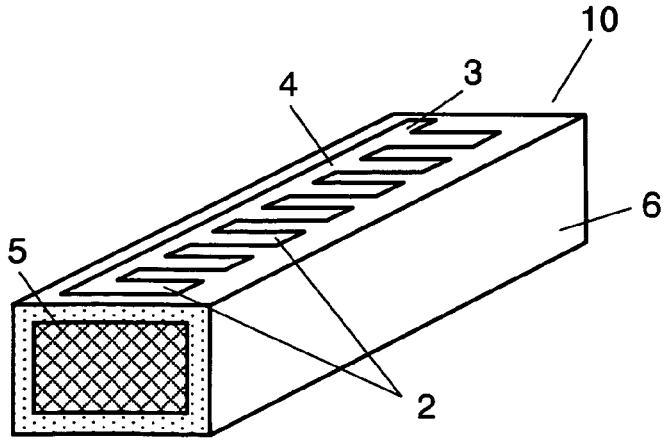
FIG. 14D is a perspective view of other example of antenna element in embodiment 10.

FIG. 14A is a plan view of insulator of conductive electromagnetic shield in embodiment 10. FIG. 14B is a plan view of conductive electromagnetic shield in embodiment 10. FIG. 14C is a perspective view of antenna element in embodiment 10. FIG. 14D is a perspective view of other example of antenna element in embodiment 10. Reference numeral 7 is an adhesive.

In embodiment 10, a conductive pattern is formed on insulator 6, and conductive electromagnetic shield 1 is composed.

First, on a sheet of insulator 6 shown in FIG. 14A, plural branches 2 and lead portion 4 shown in FIG. 14B are patterned by patterning technology such as printing, photolithography, or selective etching, and conductive electromagnetic shield 1 is formed.

More specifically, the pattern of conductive electromagnetic shield 1 is formed on the surface of insulator 6 by silk printing or other printing method. Or, a sheet of conductive material such as copper foil is adhered nearly on the entire surface of insulator 6, or after forming metal or other conductive material by vapor deposition, sputtering or plating, it is patterned by photolithography, or by selective etching using laser, the pattern of conductive electromagnetic shield 1 having a desired shape can be securely disposed in specified position.

Consequently, as shown in FIG. 14C, conductive electromagnetic shield 1 formed as conductive pattern on the surface of insulator 6 is adhered to the surface of conductor 5 of antenna element 10 by way of adhesive 7.

Thus, various conductive patterns can be easily formed on the surface of conductor 5 of antenna element 10.

As shown in FIG. 14D, meanwhile, conductive electromagnetic shield 1 may be also composed by forming a conductive pattern directly on the surface of insulator 6 covering conductor 5 of antenna element 10.

EMBODIMENT 11

Figure 15A:
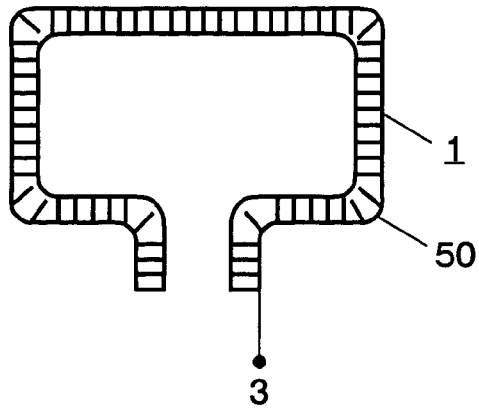
FIG. 15A is a plan view of loop antenna in embodiment 11.
Figure 15B:
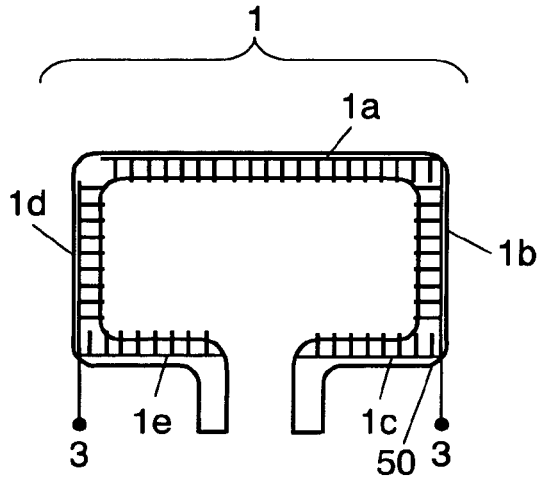
FIG. 15B is a plan view of loop antenna in embodiment 11.
Figure 15C:
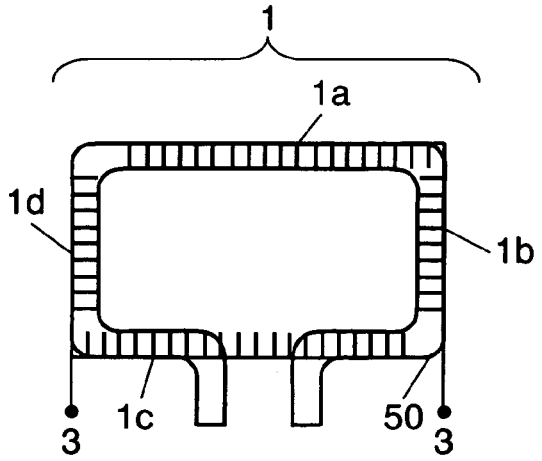
FIG. 15C is a plan view of loop antenna in embodiment 11.

FIG. 15A, FIG. 15B, and FIG. 15C are plan views of loop antenna in embodiment 11. Reference numeral 50 is loop antenna.

Conductive electromagnetic shield 1 is disposed on the surface of loop antenna 50 as shown in FIG. 15A, along the contour of its shape. Branches and lead portion of conductive electromagnetic shield 1 and conductor of loop antenna 50 are insulated and formed in the same manner as in the antenna element in any one of foregoing embodiments 1 to 10.

As shown in FIG. 15B, conductive electromagnetic shields 1*a* and 1*b* and 1*c* are coupled, and plural conductive electromagnetic shields 1*d* and 1*e* are coupled, and these coupled two sets of conductive electromagnetic shields 1 are disposed on the surface of loop antenna 50. When coupling the plural conductive electromagnetic shields 1*a* and 1*b* and 1*c* (or 1*d* and 1*e*), the mutual lead portions are connected, and one ground contact 3 at terminal end is used commonly.

They may be also configured as shown in FIG. 15C. That is, conductive electromagnetic shields 1*a* and 1*b* are coupled, conductive electromagnetic shields 1*c* and id are coupled, and two coupled sets of conductive electromagnetic shields 1 are disposed on the surface of loop antenna 50.

In any one of FIG. 15A to FIG. 15C, the structure of antenna element composed of loop antenna 50 and conductive electromagnetic shields 1 conforms to the antenna element in any one of foregoing embodiments 1 to 10. Further, the shape of loop antenna 50 is not limited to square, but may include circular or polygonal, or any shape as far as an opening is formed inside. Thus, if the extending direction of conductor of antenna element composing loop antenna 50 is not straight, by using any antenna element in embodiments 1 to 10 for example, discrepancy can be decreased in the configuration of comb tooth portions for composing the conductive electromagnetic shields disposed on the surface of conductor of loop antenna 50. As a result, fluctuations among parts of antenna element can be decreased about the suppressing effect of attenuation of magnetic near field radiated from loop antenna 50 and attenuation effect of electric far field.

EMBODIMENT 12

In embodiment 12, the communication control apparatus of wireless communication medium having the loop antenna explained in embodiment 11 is described.

Figure 16:
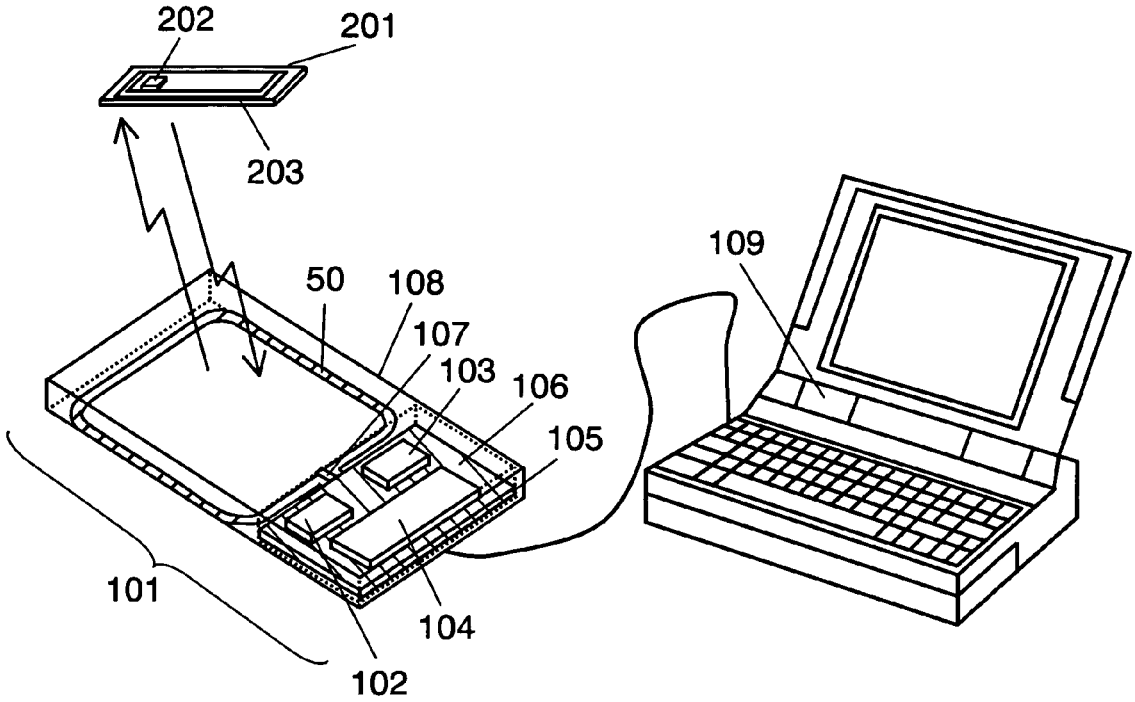
FIG. 16 is a conceptual diagram of communication status between communication control apparatus of wireless communication medium and wireless communication medium in embodiment 12.

FIG. 16 is a conceptual diagram of communication status between communication control apparatus of wireless communication medium and wireless communication medium in embodiment 12.

Contactless IC card read/write device 101 is an example of communication control apparatus of wireless communication medium. The read/write section of contactless IC card read/write device 101 comprises wireless transmitter 102, wireless receiver 103, and control board 105 mounting control unit 104. Wireless transmitter 102 supplies electric power and transmission data to loop antenna 50. Wireless receiver 103 acquires reception data from loop antenna 50. Control unit 104 controls wireless transmitter 102 and wireless receiver 103.

The read/write section is contained inside shield case 106. By putting control board 105 and others into shield case 106, it is effective to decrease leak of undesired electromagnetic wave to outside (that is, EMI noise), invasion of disturbing wave incoming from outside, and distribution of own transmission signal into reception circuit.

Resonance matching circuit 107 is disposed closely to current feed point of loop antenna 50, and is connected to loop antenna 50. Output of resonance matching circuit 107 is connected to wireless transmitter 102 and wireless receiver 103 by way of signal distribution/composition circuit (not shown) by coaxial cable.

Casing 108 accommodating loop antenna 50, control board 105 and others is made of resin material. By putting all means composing contactless IC card read/write device 101 into one casing 108, convenience of installation is substantially improved.

Reference numeral 109 is a control terminal of PC or the like. Contactless IC card 201 is an example of wireless communication medium. Contactless IC card 201 is composed of IC chip 202 and antenna coil 203.

Loop antenna 50 supplies electric power and transmission data to contactless IC card 201, and acquires reception data from contactless IC card 201. This loop antenna 50 has conductive electromagnetic shield 1 in, for example, any one of FIG. 15A to FIG. 15C in embodiment 11, but the specific constitution is omitted.

In FIG. 16, casing 108, shield case 106, and contactless IC card 201 are shown in see-through state in order to show the inside of casing 7.

Operation of communications by using contactless IC card read/write device 101 in embodiment 12 is explained below.

In FIG. 16, when only electric power is supplied from contactless IC card read/write device 101 to contactless IC card 201 (standby mode), first in contactless IC card read/write device 101, radio frequency signal of a specific amplitude is supplied from oscillation circuit (not shown) to wireless transmitter 102, and the amplified signal is sent to loop antenna 50 through current feed route.

In contactless IC card 201, through antenna coil 203 electromagnetically coupled to loop antenna 50 of contactless IC card read/write device 101, the radio frequency signal is supplied to IC chip 202. This radio frequency signal is rectifying in rectifying circuit (not shown) in IC chip 202, and is used as power source necessary for parts in contactless IC card 201.

When transmitting data from contactless IC card read/write device 101 to contactless IC card 201 (transmission mode), the operation is as follows.

In FIG. 16, in contactless IC card read/write device 101, data is transmitted from control terminal 109 or others to wireless transmitter 102 by way of control unit 104. In wireless transmitter 102, the radio frequency signal of same amplitude as supplied in the standby mode is modulated according to the transmission data. The modulated radio frequency signal is sent to loop antenna 50 by way of current feed line (not shown).

In contactless IC card 201, through antenna coil 203 electromagnetically coupled to loop antenna 50 of contactless IC card read/write device 101, the radio frequency signal demodulated according to transmission data is supplied to IC chip 202. This radio frequency signal is rectified in rectifying circuit same as in the standby mode, and is used as power source necessary for parts of contactless IC card 201. In addition, the output signal of antenna coil 203 is also supplied to reception circuit (not shown) in IC chip 202, and the transmission data is demodulated, and the demodulated transmission data is written into memory (not shown).

Finally, when contactless IC card read/write device 101 receives data from contactless IC card 201 (reception mode), the operation is as follows.

From wireless transmitter 102 of contactless IC card read/write device 101, a radio frequency signal of a specific amplitude is issued without modulation same as in the standby mode, and is sent to contactless IC card 201 by way of loop antenna 50 and antenna coil 203. In contactless IC card 201, same as in the case of standby mode, it is rectified in the rectifying circuit, and is used as power source necessary for parts of contactless IC card 201. In addition, for example, load resistance (not shown) and switch (not shown) are connected to antenna coil 203, and this switch is turned on or off depending on "1" or "0" bit of the data being read out from the memory.

When the switch is turned on or off in this manner, the load on antenna coil 203 fluctuates, and the impedance at the loop antenna 50 side in contactless IC card read/write device 101 varies depending on electromagnetic induction. As a result, the amplitude of the radio frequency current flowing in loop antenna 50 varies. That is, this radio frequency current is modulated in amplitude by the reception data of contactless card 201. The signal by this modulated radio frequency current is demodulated in wireless receiver 103 in contactless IC card read/write device 101, and reception data is obtained. The reception data is processed in control unit 104, and sent to control terminal 109 and others.

In contactless IC card read/write device 101 of embodiment 12, since loop antenna 50 has conductive electromagnetic shield as mentioned above, attenuation of magnetic near field of radiated electromagnetic wave is suppressed, and electric far field in all directions by radiated electromagnetic wave is effectively attenuated. Hence, the communication distance between contactless IC card read/write device 101 and contactless IC card 201 is maintained, and reduction of EMI noise radiated from contactless IC card read/write device 101 and loop antenna 50 is realized at the same time. Further, since contactless IC card read/write device 101 has its composing means contained in one casing 108 and integrated with loop antenna 50, it can be installed anywhere as desired.

Figure 17:
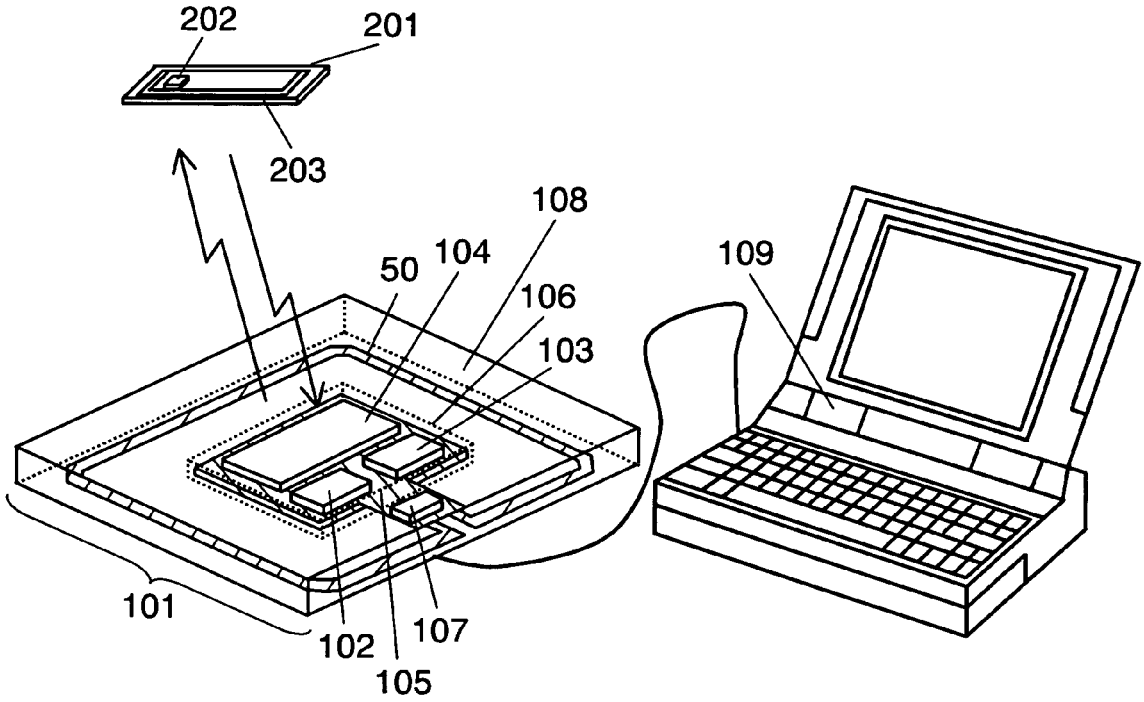
FIG. 17 is a conceptual diagram of communication status between communication control apparatus of wireless communication medium and wireless communication medium in other example of embodiment 12.

FIG. 17 is a conceptual diagram of communication status between communication control apparatus of wireless communication medium and wireless communication medium in other example of embodiment 12. As in this example, control board 105 and others may be disposed in the opening of loop antenna 50. Its operation and other components are same as explained in FIG. 16. Thus, the communication distance between contactless IC card read/write device 101 and contactless IC card 201 is maintained, and reduction of EMI noise radiated from contactless IC card read/write device 101 and loop antenna 50 is realized at the same time. Further, since contactless IC card read/write device 101 has its composing means contained in one casing 108 and integrated with loop antenna 50, it can be installed anywhere as desired.

Figure 18:
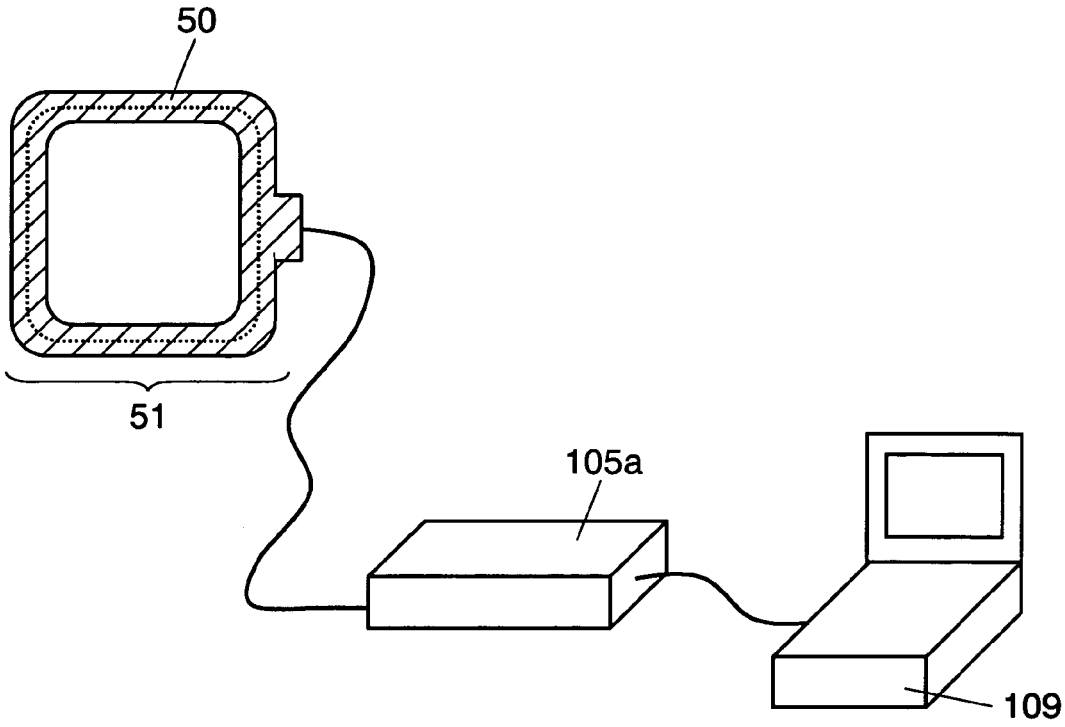
FIG. 18 is a conceptual diagram of communication status between communication control apparatus of wireless communication medium and wireless communication medium in a different example of embodiment 12.
Figure 19:
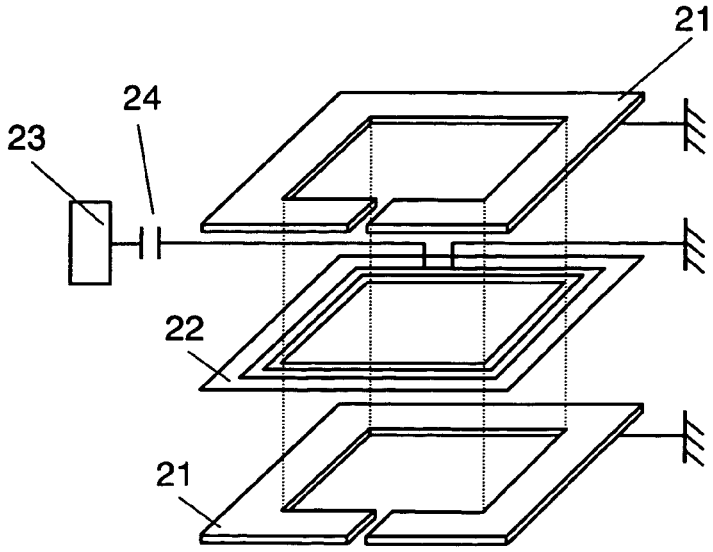
FIG. 19 PRIOR ART
FIG. 19 is a schematic perspective view of a conventional conductive electromagnetic shield.

FIG. 18 is a conceptual diagram of communication status between communication control apparatus of wireless communication medium and wireless communication medium in a different example of embodiment 12.

Although not shown in the drawing, control device 105*a* accommodates wireless transmitter 102, wireless receiver 103, control unit 104, and control board 105. Loop antenna 50 is contained in loop antenna casing 51. Loop antenna 50 is composed of an antenna element with any one of conductive electromagnetic shield shown, for example, in embodiments 1 to 10.

In such contactless IC card read/write device composed of loop antenna casing 51 mounting loop antenna 50 and control device 105*a*, since loop antenna 50 has conductive electromagnetic shield, attenuation of magnetic near field of radiated electromagnetic wave is suppressed, and electric far field in all directions by radiated electromagnetic wave is effectively attenuated. Hence, the communication distance of contactless IC card read/write device and contactless IC card is maintained, and reduction of EMI noise radiated from contactless IC card read/write device and loop antenna is realized at the same time.

Loop antenna casing 51 may be disposed on base, wall or the like. In such a case, it is not necessary to generate magnetic near field on the side of loop antenna casing 51 facing the base or wall. Accordingly, to further enhance the effect of EMI noise, other conductive electromagnetic shield is disposed between the inside of the side facing the base or wall of loop antenna casing 51 and loop antenna 50. Comb-like conductive electromagnetic shield may be disposed by a minimum required limit, that is, only on the side not facing other conductive electromagnetic shield mentioned above of the surface of loop antenna 50. As a result, the communication distance of loop antenna casing 51 and contactless IC card is maintained, and reduction of EMI noise radiated from loop antenna casing 51 and loop antenna 50 is realized at the same time. Moreover, loop antenna casing 51 can be installed anywhere as desired.

What is claimed is:

1. An antenna element comprising a conductor, and a conductive electromagnetic shield disposed on its surface by way of an insulator, wherein the conductive electromagnetic shield has a ground contact, a lead portion, and a plurality of branches, and it is composed so as to determine uniquely the route from an arbitrary point of branches to the ground contact by way of the lead portion.

2. The antenna element of claim 1, wherein the conductive electromagnetic shield is comblike, and a comb spine portion is composed of the lead portion having the ground contact at the terminal end, and a comb tooth portion may be composed of the plurality of branches extended therefrom.

3. The antenna element of claim 2, wherein the conductor extending direction is formed to intersect with the disposing direction of the comb tooth portion in the comblike conductive electromagnetic shield.

4. The antenna element of claim 2, wherein the conductor extending direction is formed to cross orthogonally substantially with the disposing direction of the comb tooth portion in the comblike conductive electromagnetic shield.

5. The antenna element of claim 1, wherein the conductive electromagnetic shield is disposed to cover at least part of the conductor surface by way of the insulator.

6. The antenna element of claim 1, wherein at least either the conductor or the plurality of branches is covered with the insulator.

7. The antenna element of claim 1, wherein the insulator is formed of an adhesive made of insulating material for adhering and disposing the conductive electromagnetic shield to the conductor surface.

8. The antenna element of claim 1, wherein the conductive electromagnetic shield is formed as a conductive pattern on the insulator surface.

9. A loop antenna composed of the antenna element of claim 1 formed in a loop shape.

10. A communication control apparatus of wireless communication medium comprising the loop antenna of claim 9, and read/write device connected to the loop antenna.

11. An antenna element comprising a conductor, and a conductive electromagnetic shield disposed on its surface by way of an insulator, wherein the conductive electromagnetic shield has a ground contact, a lead portion, and a plurality of branches, and the plurality of branches are electrically connected so as to form an open loop and connected to the ground contact by way of the lead portion.

12. The antenna element of claim 11, wherein the conductive electromagnetic shield is comblike, and a comb spine portion is composed of the lead portion having the ground contact at the terminal end, and a comb tooth portion is composed of the plurality of branches extended therefrom.

13. The antenna element of claim 12, wherein the conductor extending direction is formed to intersect with the disposing direction of the comb tooth portion in the comblike conductive electromagnetic shield.

14. The antenna element of claim 12, wherein the conductor extending direction is formed to cross orthogonally substantially with the disposing direction of the comb tooth portion in the comblike conductive electromagnetic shield.

15. The antenna element of claim 11, wherein the conductive electromagnetic shield is disposed to cover at least part of the conductor surface by way of the insulator.

16. The antenna element of claim 11, wherein at least either the conductor or the plurality of branches is covered with the insulator.

17. The antenna element of claim 11, wherein the insulator is formed of an adhesive made of insulating material for adhering and disposing the conductive electromagnetic shield to the conductor surface.

18. The antenna element of claim 11, wherein the conductive electromagnetic shield is formed as a conductive pattern on the insulator surface.

19. A loop antenna including an antenna element comprising a conductor, and a conductive electromagnetic shield disposed on its surface by way of an insulator, wherein the conductive electromagnetic shield has a ground contact, a lead portion, and a plurality of branches, and the plurality of branches are electrically connected so as to form an open loop and connected to the ground contact by way of the lead portion, said antenna element formed in a loop shape.

20. A communication control apparatus of wireless communication medium including a loop antenna including an antenna element having a conductor, and a conductive electromagnetic shield disposed on its surface by way of an insulator, wherein the conductive electromagnetic shield has a ground contact, a lead portion, and a plurality of branches, and the plurality of branches are electrically connected so as to form an open loop and connected to the ground contact by way of the lead portion, said antenna element formed in a loop shape, and read/write device connected to the loop antenna.

21. An antenna element composed by disposing a conductive comblike element on a conductor surface by way of an insulator, wherein the conductive comblike element is disposed to cover the outer circumference of the conductor surface.

22. An antenna element composed by disposing a conductive electromagnetic shield having a comblike shape on a conductor surface by way of an insulator, wherein the insulator is formed of an adhesive made of insulating material for adhering and disposing the conductive electromagnetic shield to the conductor surface.

23. A loop antenna including an antenna element formed by disposing a conductive comblike element on a conductor surface by way of an insulator, said antenna element formed in a loop shape.

24. A communication control apparatus of wireless communication medium comprising a loop antenna composed of an antenna element composed by disposing a conductive comblike element on a conductor surface by way of an insulator formed in a loop shape, and read/write device connected to the loop antenna.

* * * * *